United States Patent [19]

Schneider et al.

[11] Patent Number: 5,072,671

[45] **Date of Patent: * Dec. 17, 1991**

[54] SYSTEM AND METHOD TO APPLY A PRINTING IMAGE ON A PRINTING MACHINE CYLINDER IN ACCORDANCE WITH ELECTRONICALLY FURNISHED IMAGE INFORMATION

[75] Inventors: Josef Schneider, Munich; Hartmut Fuhrmann, Karlsfeld; Ingo Köbler, Anhausen, all of Fed. Rep. of Germany

[73] Assignee: MAN Roland Druckmaschinen AG, Offenbach am Main, Fed. Rep. of Germany

[ * ] Notice: The portion of the term of this patent subsequent to Sep. 25, 2007 has been disclaimed.

[21] Appl. No.: 430,511

[22] Filed: Nov. 1, 1989

[30] Foreign Application Priority Data

| | | | |
|---|---|---|---|
| Nov. 9, 1988 | [DE] | Fed. Rep. of Germany | 3837897 |
| Nov. 9, 1988 | [DE] | Fed. Rep. of Germany | 3837898 |
| Nov. 9, 1988 | [DE] | Fed. Rep. of Germany | 3837941 |
| Nov. 9, 1988 | [DE] | Fed. Rep. of Germany | 3837978 |
| Nov. 9, 1988 | [DE] | Fed. Rep. of Germany | 3837979 |

[51] Int. Cl.[5] ..... B41C 1/10; B41C 1/04; B41C 1/05; B41C 1/18

[52] U.S. Cl. ..... 101/467; 101/401.1

[58] Field of Search ..... 101/401.1, 467, 466, 101/465, 470, 127.21, 127.4

[56] References Cited

U.S. PATENT DOCUMENTS

| | | | |
|---|---|---|---|
| 3,168,864 | 2/1965 | Brandl et al. | 101/467 X |
| 3,299,807 | 1/1967 | Evensen | 101/467 |
| 3,678,852 | 7/1972 | Feinleib et al. | 101/467 X |
| 3,745,235 | 7/1973 | Bestenreiner et al. | 101/467 X |
| 3,859,920 | 1/1975 | Ritzerfeld | 101/467 |
| 4,718,340 | 1/1988 | Love, III | 101/467 X |
| 4,833,486 | 5/1989 | Zerillo | 101/467 |
| 4,846,065 | 7/1989 | Mayrhofer et al. | 101/467 X |
| 4,930,417 | 6/1990 | Isobe | 101/467 X |
| 4,958,564 | 9/1990 | Fuhrmann et al. | 101/467 |

FOREIGN PATENT DOCUMENTS

| | | |
|---|---|---|
| 0101266 | 2/1984 | European Pat. Off. . |
| 3248178 | 7/1984 | Fed. Rep. of Germany . |
| 59-142146 | 8/1984 | Japan . |

*Primary Examiner*—Clifford D. Crowder

*Attorney, Agent, or Firm*—Frishauf, Holtz, Goodman & Woodward

[57] ABSTRACT

To apply a printed image on a printing form, a transfer tape is passed under a recording head, the transfer tape receiving, upon application of energy to the recording head, substance particles which change the surface of the printing form to have, respectively, ink accepting and ink repellent surface areas or, respectively, to fill the cells of a gravure cylinder, the transfer tape then being applied against the printing form and the substance particles therefrom being transferred to the printing form under influence of heat, or other energy, e.g. electrostatic or electromagnetic. Recording on the transfer tape, under control of an electronic control unit, can be carried out on a point-by-point or line-by-line basis at a recording speed which is slow with respect to the speed of operation of the reproducing head applying the substance particles to the printed form, so that information can be stored on the tape while a previously prepared printing form can print on the substrate. The information can be erased from the printing form by melting off the substance particles, after cleaning of residual ink, and wiping, blotting or blowing off the molten particles.

57 Claims, 11 Drawing Sheets

SYSTEM AND METHOD TO APPLY A PRINTING IMAGE ON A PRINTING MACHINE CYLINDER IN ACCORDANCE WITH ELECTRONICALLY FURNISHED IMAGE INFORMATION

Reference to related publications:

German Pat. No. 32 48 178.

Reference to related applications, the disclosures of which are hereby incorporated by reference, and assigned to the assignee of the present invention:

U.S. Ser. No. 07/417,299, filed Oct. 5, 1989, now U.S. Pat. No. 4,958,564 FUHRMANN et al U.S. Ser. No. 07/418,137, filed Oct. 6, 1989 and abandoned in favor of a continuation 07/609,009, filed Oct. 29, 1990 FUHRMAN et al.

The present invention relates to printing machines and a method to apply a printing image on a printing machine cylinder in accordance with electronically furnished image information, and more particularly to apply the printing image directly on a printing cylinder without requiring placement of an unchangeable or unvarying image carrying plate or surface on the printing cylinder.

Background. German Pat. No. 32 48 178 describes a method for use with an offset printing machine in which digital image information is applied to a recording head which, selectively, causes melting of meltable substance particles located on a thermo transfer foil, so that the thermo transfer foil will have placed thereon a representation of the digital information in form of ink-accepting, i.e. oleophilic and ink-repellen.. or, respectively, water-repelent, i.e. hydrophobic and water-accepting, i.e. hydrophilic areas. The thermo transfer foil, which carries the information in point form, is then engaged against a printing cylinder for direct transfer of the information thereto.

The point-form energy application, specifically heat, corresponds to the electronic image information. An oleophilic or ink-decepting substance, coating the thermo transfer foil, is dissolved off, and applied to the printing cylinder. This system is complex since the transfer is in image point units, and can be applied, at any time, only to a single printing cylinder. The time taken to transfer the image to a printing cylinder is substantial due to the point-by-point transfer of the image information.

High-quality printing can be obtained by using gravure cylinders. In the gravure printing method, the cylinder is formed with tiny depressions, or receptors, located between a ridge pattern. Usually, the receptors or cells are formed by mechanical, electromechanical, electrothermal, or chemical material removal, in part, if desired, with intermediate photooptic or chemical auxiliary processes. The receptors, to receive different quanties of ink, have different size, depth or spacing from each other. Methods to make printing cylinders of this type are expensive and complex, and must be carefully controlled. The numerous steps required thereby take much time and effort. Printing cylinders which, in large machines, weigh up to several tons, have to be removed from the machine to make a new printing cylinder, in negative form. The imaging of these new cylinders, then, has to be carried out in large machines, and the then imaged cylinders have to be returned to the printing machines. Thus, gravure printing, although it provides high-quality printed subject matter, is economically suitable only if a very high number or copies of editions are required.

Definition

The term "printing form" as used herein defines a printing machine element which has a surface with ink applying surface portions and non-inking surface portions, for subsequent transfer of printing information onto a substrate, and thus is used in the extended sense of the "form" described, for example, in "Machine Printing" applied both to a planographic as well as a gravure form and not only to a raised-letter or letterpress form (or form, in the British spelling), see the definition of "form" in Webster, namely: "the total combination of the letterpress matter imposed and locked up in a chase . . .; set-up type". ("Machine Printing", by Durant, Meacock & Whitworth, Hastings House, Publishers, New York, N.Y. ©1973).

The Invention

It is an object to provide a system and a method to generate printing cylinders carrying printing images which operates rapidly and efficiently, which is versatile, and applicable to various types of printing systems and methods, is economical, and does not require extensive apparatus separate from the printing machine, or incompatible therewith.

Briefly, and in accordance with a feature of the invention, a transfer tape is used which, for example, has a surface of polytetrafluorethylene (PTFE), known under the trademark "TEFLON", with a coating of a substance which can melt upon application of energy, for example polyethylene, a wax, or the like. This transfer tape is passed past a recording head which, selectively, melts discrete areas in accordance with electronically furnished information, in point form; the transfer head may carry a plurality of electrodes, to directly generate a plurality of images in point form at once, the tape being thereby recorded on, preferably transversely to its longitudinal extent, in line-by-line form Alternatively, rather than melting a coating of the tape, the tape has applied thereto, selectively and in accordance with the electronically furnished image information, respectively ink-accepting or ink-rejecting, water-accepting substances, projected there against in form of jets, similarly to the ink-jet printing of computer output printers. The printing cylinder may already have a surface which can, selectively, accept electronically controlled image generating material, that is, a substance which either accepts ink or accepts water (water is ink-repellent) - in dependence on whether a positive or negative image is to be applied. For example when if the printing cylinder is a gravure cylinder already formed with receptor depressions, the substance can be applied directly to the receptor impressions, for example by a jet application, or can be transferred thereto by the transfer tape.

The transfer tape, carrying a composite or general printing image, which may be characters or other graphic representations, can also be applied against a planographic cylinder, for transfer of the surface substance thereto. The system and method is equally applicable to screen printing cylinders.

In accordance with a preferred feature of the invention, and to eliminate difficulties with tolerances in the thickness of the transfer tape, or spacing between electrodes and a facing counter cylinder, the surface on which the, respectively, hydrophilic or oleophilic substance is applied is slightly soft or yielding; this permits, either, direct transfer on a printing cylinder or indirect transfer by, what might be termed, a double offset process.

Interposing the transfer tape, particularly when using a planographic process, has the advantage that the transfer speed is substantially increased over that of the prior art, since transfer of information in line or multiple line form can be substantially higher than transfer of substance particles on a point-by-point basis. The transfer tapes can be made independently of printing on a substrate itself. Thus, a single transfer tape can supply printing images for a plurality of printing cylinders.

The scope of information on the transfer tape, which forms intermediate or buffer stored printed images, may contain all the printed information required, for example, for a number of printing cylinders in a multi-cylinder printing machine. The transfer tape does not require more space or storage area than that of a single copy of the printed substrate. It can be prepared, in dependence on the type of printing machine, such that it uses and records, if desired, those means or information which are necessary for guidance, transport and register adjustment of the respective printing cylinders, which are already present in the machine, or adjusted for a specific printing web. Preferably, the transfer tape has a base structure which, essentially, does not stretch and distort, on which the coating of TEFLON is placed.

DRAWINGS

FIG. 1 illustrates a two- printing system perfecting printing press, in schematic form, and application of a transfer tape to a selected printing cylinder thereof;

FIG. 2*a* is a highly schematic side view of application of printing information to a transfer tape retained in a cassette;

FIG. 2*b* is a schematic side view of the tape in the cassette;

FIG. 2*c* is a schematic side view of application of the information on the cassette unto a printing cylinder;

FIG. 2*d* is a schematic side view illustrating application of oleophilic material on a tape surface;

FIG. 2*e* is a schematic representation of electrostatic application of ink distribution controlling substance on the tape;

FIG. 2*f* is a schematic side view, similar to FIG. 2*c*, and illustrating electrostatic enhancement of substance transfer to a printing cylinder;

DETAILED DESCRIPTION

The system, basically, uses image information derived from an electronic image storage element, such as a computer, a magnetic disk, or other electronic memory, which generate image information in form of binary digits This digital image information is used to generate discrete melting of a substance, such as a thermoplastic, wax or the like, which has a predetermined ink-water affinity. Melting the substance changes the characteristic thereof, with respect to the ink-water affinity, so that on a carrier tape for the substance, an image is generated representative of the stored electronic data. The melted and re-frozen or re-solidified particles of the substance can be directly applied to the printing cylinder, for example for gravure printing, or can be intermediately stored on the tape, so that, by subsequent application of energy thereto, the image can be transferred directly to a printing cylinder. This last transfer is in line or surface area form, and thus can be carried out substantially more rapidly than the point-by-point melting and re-solidification of the substance on the tape. Thus, substantial economy in time and apparatus can be effected.

Figure 1:
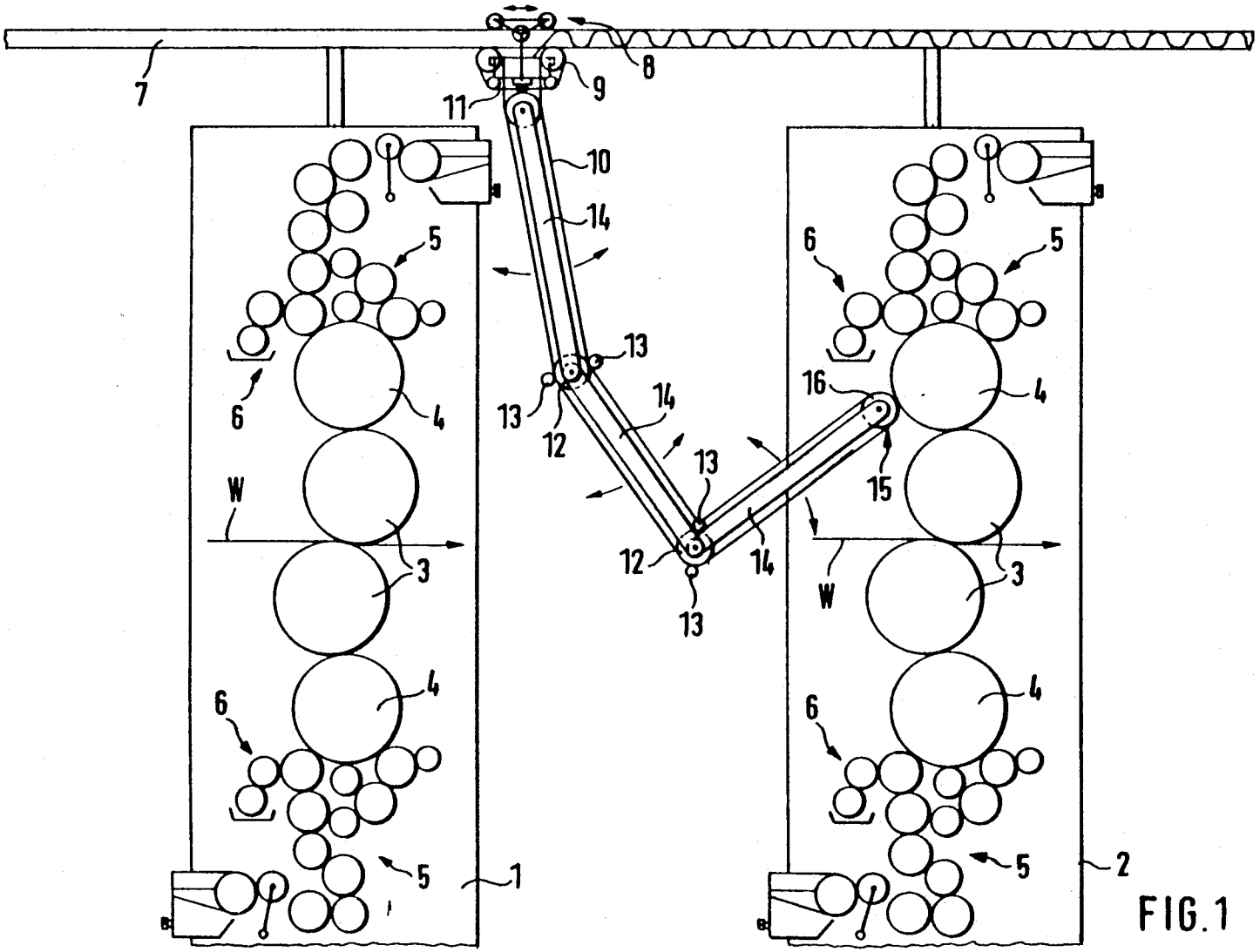

Referring now to FIG. 1, which is a highly schematic view of a four-printing unit printing machine. The printing machine has two printing systems, 1, 2, each of which has a rubber blanket cylinder 3, a printing form cylinder 4, an inker 5 and a damper 6. Since the stations and units, as such, are conventional, they are shown only in schematic representation and any suitable construction may be used.

In accordance with a feature of the invention, the printing information is applied to the plate cylinders by a printing image containing transfer tape.

A track or rail system 7 is located above the printing units 1, 2. The track or rail system may be similar to a traveling crane system, on which a traveler 8 can run. The traveler 8 carries an image transfer unit 9, described in more detail with reference to FIG. 2*a*, which receives image information over a connecting line 23 (FIG. 2*a*), for example from an electronic image signal memory. The transfer unit 9 transfers the received signals on a transfer tape 10. The transfer tape 10 is carried past the transfer head 9 in steps, to receive recording on a line-by-line basis. The transfer tape 9 has a coating or substance thereon which, upon application of energy thereto, causes melting of the substance.

Transfer of the substance to the tape 10 can be carried out in various ways. For example, in a thermo transfer process, a tape foil 11 is reeled off in contact with the transfer tape 10 between the head 9. The head 9 is supplied with heatable elements, the foil 11 having the meltable substance thereon located on the side facing the tape 10. Upon application of energy to the heatable elements, the heatable elements melt individual regions out of the foil 11 and press these so melted substances on the transfer tape 10, where they immediately solidify, since the tape 10 is relatively cold with respect to the heat of the heating elements. A roller about which the tape 10 runs can also ensure immediate solidification.

Other ways of transferring image information to the tape 10 can be used, for example in accordance with the resistive-ribbon methods. In this system, the image transfer unit 9 has electrodes thereon which are engaged with a foil having a plurality of layers of different electrical resistance. Upon current flow through a layer of high resistance, the required heat to melt the meltable substance on the resistive ribbon, which is on the foil, is obtained.

The transfer tape 10 may also have the meltable substance directly applied, for example by use of heatable nozzles which eject jets of the molten substance. These jets, whether they eject the molten substance or not, operate, basically, similarly to the ink jet printers, well known in connection with computer output printers. The molten substance is sprayed or ejected by a jet on the transfer tape 10, or it can be transferred thereto by direct engagement between the emitted or ejected substance and the transfer tape 10. An intermediate arrangement, using the foil 11 on which the substance is applied by the jets, for subsequent transfer to the tape 10, may also be used.

The transfer of the substance to the transfer tape 10 can also be carried out in two sequential steps, by first generating a representation of the image to be formed on the transfer tape, by electrographic methods, electro-optical methods, or magnetic graphic methods. The so generated images, by providing discrete charge or no-charge areas, then are subjected to a substance similar to a toner in copying machines, which, in dependence on the charge applied to the transfer tape, adheres more or less to the transfer tape—as controlled by the electronic image generating memory. If necessary, the toner or, rather, the substance, can be solidly adhered to the transfer tape by controlled heating.

The transfer tape 10, see FIG. 1, is looped about an arm similar to a robot handling arm used in printing machines, for example, to assemble and re-assemble cylinders or elements in the machine. The assembling apparatus is looped about deflection rollers 12, located inwardly of a link structure 14, with joint at the locations of the deflection rollers. Outwardly placed counter rollers 13 hold the tape 10 in engagement with the rollers 12 at the joints of the links 14. The respective joints, coupled by links, include additional arrangements for transfer of information, and power to position the system of the links 14 as desired, and to permit separate pivoting of the respective portions of the overall system formed by the joints 12, 13 and the links 14, e.g. signal and power cables. Such arrangements, and the required motor units, are well known in the technology relating to manufacture and assembly of large structures and machines, and are also well known in connection with automobile manufacture; a more detailed discussion, thus, is not necessary.

The transfer tape 10 is positioned at its upper end on the head 9 and, by suitable control of the links 14, can be placed in engagement with respective cylinders 4 of all of the printing units 1, 2, both on the prime printing as well as on the verso side.

An image reproducing unit 15 is located at the terminal end of the last link 14. This reproducing head, preferably, is in form of a heated or heatable roller 16. Roller 16 engages the transfer tape 10 against a selected one of the printing cylinders 4 and, by heating, melts the waxy substance and transfers it to the respectively selected printing cylinder. This transfer can occur in line form, or row form, or in surface engagement, that is, by a plurality of lines, simultaneously or essentially simultaneously, and thus is carried out substantially more rapidly than the point-by-point transfer of image information by the head 9 on the transfer tape 10.

When a printing cylinder 4 is completely imaged, the links 14 are controlled to remove the transfer tape 10 from engagement with the printing cylinder 4. The printing cylinder 4, thus, can start immediately to transfer printed information on a web W running between two blanket cylinders 3. In the meanwhile, the transfer tape can be engaged against another printing cylinder 4, to apply thereto an intermediate or buffer stored image in form of meltable particles. Likewise, the time of continued printing by the first printing cylinder 4 can be used to provide a new printing image on the transfer tape 10 by the recording head 9.

Preferably, the drive of the transfer tape 10, controlled for example from the recording head 9, has two different speeds: a low, step-by-step indexing movement for point-by-point transfer of the meltable substance from the foil 11 to the transfer tape 10, and a second, faster continuous or indexed run of the tape 10 for line-by-line or multiple-line transfer of the meltable substance on the respectively selected printing cylinder 4.

The recording head 9 need not be placed on the carriage 8; it can be placed remotely therefrom, and transfer of the image on a printing cylinder 18 (FIG. 2*c*) can be carried out in a different sequence.

Figure 2A:
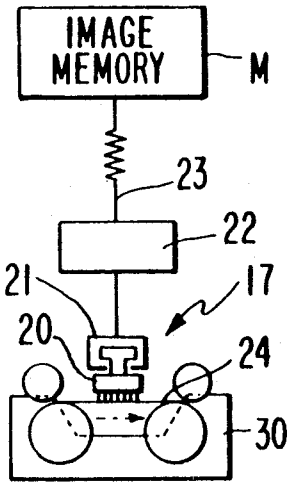
Figure 2B:
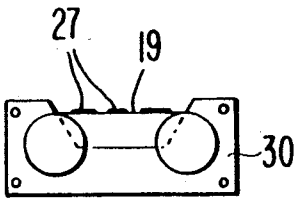
Figure 2C:
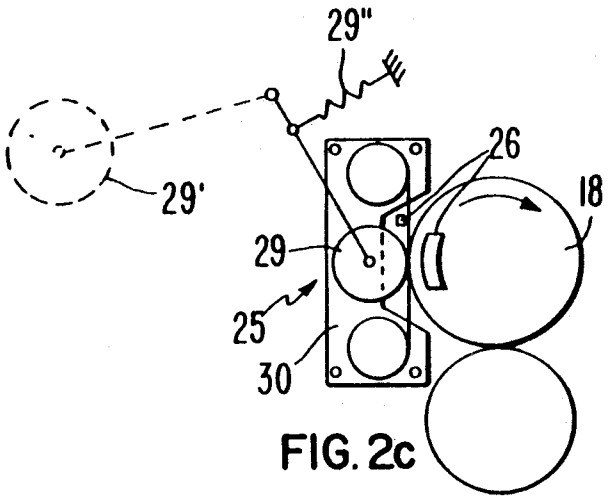

Referring now to FIGS. 2*a* to 2*c*:

The recording unit 17 is separate from the offset printing machine. To transfer the printing image in form of particles of a substance which influences the ink/water affinity of a printing cylinder 18, the transfer tape 19 (FIG. 2*b*) is provided, which is located in a cassette 30, from which it can be spooled and re-spooled, as desired, in two directions.

The recording head 17, similarly to the recording unit 9 of FIG. 1, is a thermo transfer unit. The arrangement described in connection with FIG. 1 may, of course, also be used, and the tape 19 can be elongated, and not within a cassette—as described in connection with FIG. 1.

The thermo head 20 has at least one, and preferably a whole group of pin electrodes or heating elements which can be moved longitudinally transversely to the running direction of the transfer tape 19 in a suitable guide way or track 21. The movement of the printing head, and the energy application to the electrodes or heating elements, respectively, is controlled by a computerized control unit 22 which is coupled via a signaling line 23, shown only schematically, with an electronic or opto-electronic image storage device or memory M. A foil tape 24 is positioned between the electrodes or heater elements of the head 20 and the tape 19, or 10, respectively, the foil tape 24 being coated at its bottom side with the substance which can readily melt. In operation, the heater elements, in accordance with information supplied from the image memory M, transfer the image information by controlled heating of discrete areas or regions of the foil and melting of the substance thereon. These melted particles are transferred to the upper side 6*f* the transfer tape 19, and immediately solidify thereon at the cold surface thereof. The substance parts can be intended for one image line; or, by use of an array of heating elements or electrodes, can be transferred for a plurality of imaging lines, so that an area-graphic representation can be transferred. After transfer of one line, or a plurality of lines, the transfer tape 10 is indexed by one, or the appropriate number of image lines, and then the next line or lines are transferred to the tape 19.

Preferably, the tape 19 is formed of two layers, which is desirable to retain the required register With respect to longitudinal direction, the tape is, therefore, made of a base layer very strong in tension, and a cover layer which then carries the melted and then solidified substance particles. This cover layer should have poor adhesive characteristics, yet be highly temperature resistant. A cover layer of polytetrafluorethylene (PTFE), commercially known as TEFLON, is very suitable. In the thickness dimension, the transfer tape 19 should have some compressibility, so that variations in linearity upon transfer of the substance to the printing cylinder 18 by a suitable application pressure can be compensated.

The length of the transfer tape 19 in a cassette 30 preferably is so determined that a plurality of complete images, for example all that are required for one operating shift or for a day's production are stored on the tape 19. It is, of course, equally possible to store only one complete printing image for one printing cylinder, and, while that one is being transferred to a printing cylinder, to generate another tape for other printing information and for another cylinder.

After imaging of the tape 19 in the cassette 30, in accordance with FIG. 2*a*, the cassette is removed from the unit 17, and transported for engagement with a printing cylinder 18, see FIG. 2*c*. FIG. 2*b* illustrates, highly schematically, melted substance areas or particles 27 on the tape 19, which is then engaged against the cylinder 18.

Transport and placement of the cassette can be done in accordance with any well known arrangement, and do not form part of the present invention. For example, the cassette 20 can be held by suitable grippers coupled to the frame of the printing machine, or suspended or secured to the ceiling of the plant in which it is installed, for transport to a selected printing cylinder 18, and for placement in engagement with the printing cylinder 18 by an interlocking holder shaped to receive the cassette. As well known in connection with audio tape cassettes, video cassettes and the like, upon engagement of the cassette in a holder made especially therefor, a drive connection can be established at the same time between a drive element for the tape in the cassette and an external drive, for example for the printing cylinder. At least one of the reels within the cassette should be driven. The printing cylinder and the transfer tape must be moved synchronously to ensure transfer of the image from the tape to the printing cylinder in accordance with a predetermined register.

The particles of the substance which are to be transferred to the printing cylinder 18 can be transferred by thermo action on the back side of the transfer tape 19 by the reproducing head 25, see FIG. 2*c*; thermal effect can be obtained by pressing the transfer tape 19 against the printing cylinder 18 by a pressure roller 29. If the particles on the transfer tape 19 have ferromagnetic characteristics, or are capable of carrying a charge, or are polarized particles, magnetic or electrostatic support for the transfer can be obtained. For example, the printing cylinder 18 may have, within its circumference, located one magnet of a magnet pair 26, the other one being located behind the transfer tape 19. Rather than using magnets 26, the back side of the transfer tape 19 may have an electrode 18' located thereon, and the printing cylinder 18 grounded, see FIG. 2*f*. The electrode and the printing cylinder are then subjected to a voltage, so that an electrical field will be formed, enhancing transfer of particles from the tape to the printing cylinder. Preferably, the transfer drum 29 is heated. Before the cassette 30 is in position for transfer of particles, the roller 29 can be placed in the position shown at 29', FIG. 2*c*, for subsequent engagement against the back side of the tape 19, and heating thereof. Various other arrangements are possible, for example to integrate an image transfer head in each cassette and, upon engagement thereof with a printing cylinder like cylinder 18, causing simultaneously a coupling of the transfer unit to an energy source, for example for heating an integrated cylinder 29 within the cassette. Spring 29'' applies resilient force on roller 29.

The method and system of the present invention has an additional advantage, namely that the image on the printing cylinder can be easily erased and, thereafter, a new image placed thereon. It is only necessary to first wash off remaining ink from the cylinder 18, and then provide internal or external heat until the substance previously carrying the ink becomes liquid. A suitable doctor blade or wiper arrangement then can be used to remove remaining substance particles from the cylinder, so that it can be programmed with a new printing image, from a new cassette or tape 19, or another portion of the tape 19.

The surface of the printing cylinder 4, 18 is preferably coated or formed with a continuous hydrophilic surface; the image portions which carry the regions to be inked are then formed by transfer thereto of the thermoplastic, oleophilic material, for example wax or a thermoplastic.

Figure 2D:
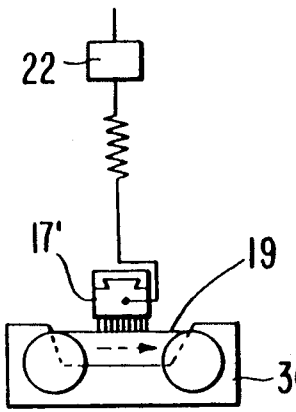
Figure 2E:
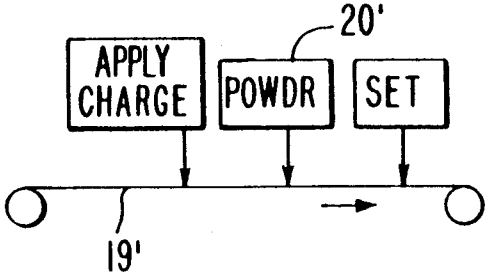
Figure 2F:
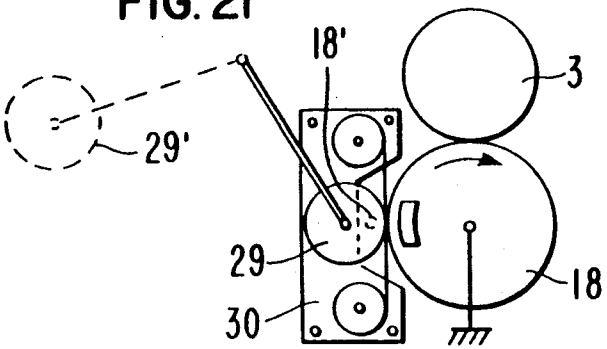

FIG. 2*d*, schematically, shows application of fluid ink-accepting particles directly on the tape 19 by an application head 17', similar to an ink jet in a computer printer; FIG. 2*e* illustrates, schematically, application of a latent image on a tape 19', which is capable of retaining magnetic or electrostatic image areas oleophilic substance is then applied to the tape by a spray or powdering head 20', excess material wiped or blown away, and the remaining material which is bound to the tape in accordance with the prior latent image is set for example by heat or radiation, if the material is radiation-sensitive. Transport of the tape is shown only schematical y and may be in accordance with any well known arrangement.

Figures 3, 4:
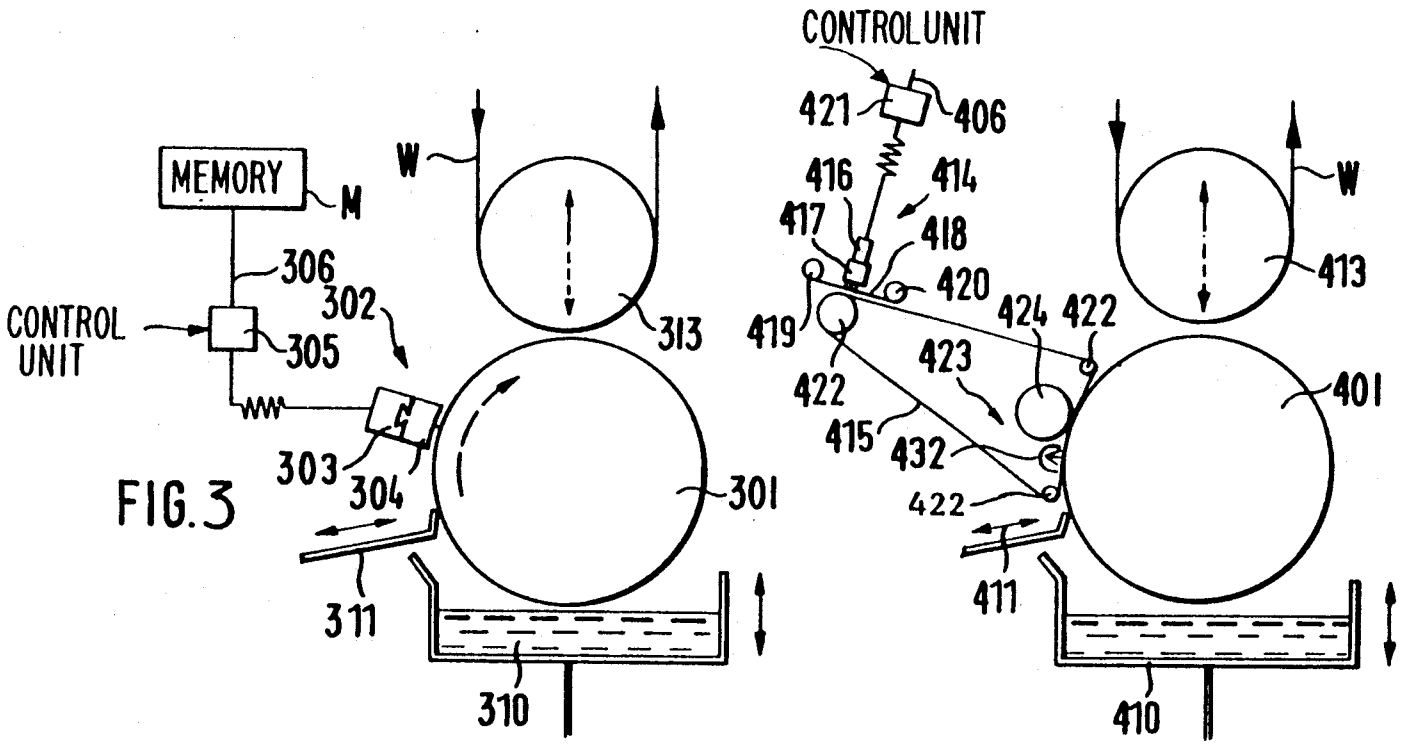
FIG. 3 is a highly schematic side view of the printing arrangement for a gravure printing machine in which the gravure cylinder is directly prepared for gravure printing.
FIG. 4 is a schematic side view of the printing machine of FIG. 3, in which the gravure cylinder is imaged by a transfer tape.

The invention is not restricted to placing material which changes the affinity of a printing cylinder with respect to ink on a planographic cylinder. Referring now to FIG. 3, which illustrates the application of the present invention to a gravure cylinder: Cylinder 301 is a gravure cylinder of a customary rotary gravure printing machine. An image forming unit 302 is applied against the cylinder 301, the unit 302 being capable of traveling axially with respect to the cylinder 301 guided in a guide track 303. The unit 303 carries the actual application head 304 which has at least one nozzle through which a liquefied, but normally solid substance is sprayed on the gravure cylinder 301, under pressure. The amount of substance being sprayed, that is, for how long, how much, and under what pressure, is controlled by a control unit 305, similar to control of an ink jet printer, and receiving control signals from a control line 306 which, in turn, is controlled by an image st-ring memory M, including, of course, the customary circuitry to convert the information stored in the memory into suitably timed digital signals for handling by the unit 303 and the jet 304 The control unit 305 reads the signals, received in digitally coded form, from the memory. Transfer of information from the memory via the control unit 305 is in point-by-point form, line or row by line, on the cylinder 301. In accordance with a preferred feature of the invention, a plurality of nozzles, located next to each other in circumferential direction of the cylinder 301, can be used, so that a plurality of lines can be recorded on the cylinder 301 in parallel. The range of information which can be recorded on the cylinder 301, that is, the variation in quantity of the transferred substance, is preferably based on one byte of information for each pixel or image point, which provides for 356 possible variations in ink density.

Figure 5:
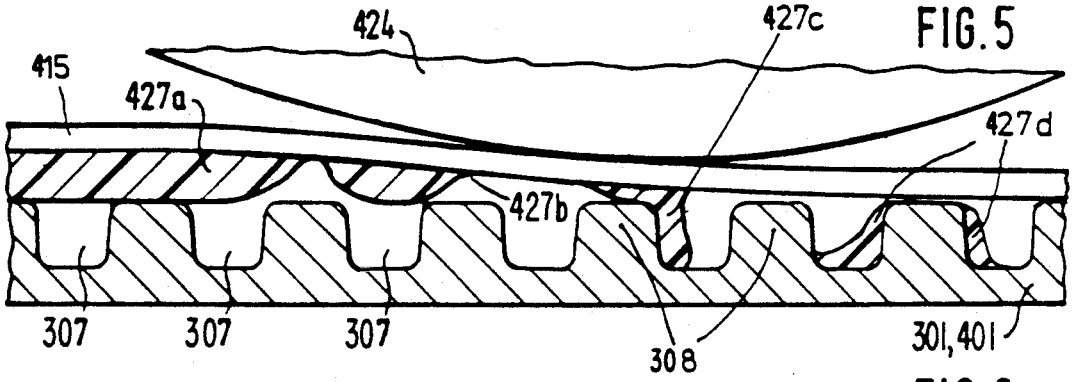
FIGS. 5 through 7 illustrate, in enlarged representation, application of image controlling oleophobic substances to a gravure cylinder, in different stages of application.

The surface of the printing cylinder 301 is shown in detail and to a much larger scale in FIG. 5; it has a plurality of receptor recesses or cells 307, separated from each other by separating strips or ridges 308. This is standard gravure printing cylinder construction. The depth or the cells 307 is so selected that it can hold at least the maximum quantity of ink to be transferred to a substrate, for example a sheet or a web W (FIG. 1).

The quantity of liquefied substance injected, by the unit 302 into the receptor 307 will be inversely proportional to the image information. Upon contact with the surface of the gravure cylinder 301, the substance will harden immediately to form, on the base and on the edge of the receptors 307, a partial filling, see FIG. 6, in form of layers or obstructions 309. Upon subsequent inking of the surface of the gravure cylinder 301, only so much ink can be filled into the receptors 307 until the volume is flush with the surface; this, the volume of ink will correspond to the volume of the receptors 307 less the fillings 309.

Figure 6:
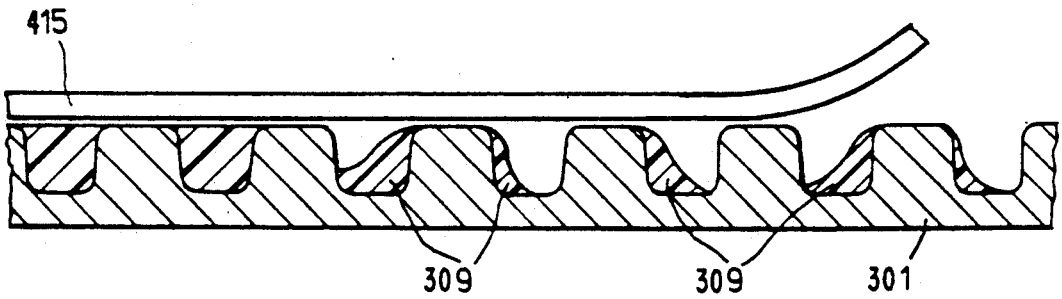

After the cylinder has been prepared, so that its surface will have the for shown in FIG. 6, the image forming unit 302 is removed from the cylinder and it is ready to print First it has to be inked, which can be done as well known, by dipping the cylinder 301 into an ink trough 310 (FIG. 3). Excess ink can be removed by a doctor blade unit 311 which can be further so placed that any excess ink is returned immediately to the ink trough 310. The doctor blade 311 will ride on the ribs 308. The now inked image, carrying as much ink as the respective receptors can hold, is the applied to a substrate web W, looped about a suitable impression cylinder 313, which is then moved in contact with the cylinder 301, with the web W interposed.

The direct jet method, thus, is applicable to gravure cylinders for example; the gravure cylinder can, however, also be prepared to carry an image by using a transfer tape as described in connection with FIGS. 1 and 2.

FIG. 4 illustrates application of a printing image on a gravure cylinder 401 by a transfer tape 415, which receives its information carriers from an image application unit 414. Unit 414 is located on a guide rail or holder 416 extending axially with respect to the cylinder 401, so that it can travel therealong; a thermo printing head 417 is located on the rail 416, which can be similar to the head 20 (FIG. 2*a*), transferring meltable and solidifiable substance from a thermo transfer tape 418, which, at irs underside, is coated with heat transferable substance. Type 418 is spooled on a reel 419 and, after each line, about which the transfer tape 415 is moved, is likewise synchronously transported. The already used part of the transfer foil 418 is spooled on a used reel 420, from where it can be re-used by recoating.

Information derived from the memory M is read out through read-out line 406 and processed in control unit 421 to control the head 417. The image information is digitally coded and, in accordance with the image information, different quantity of substance is melted off the tape 418 and transferred to the transfer tape 415, point-by-point, line-for-line; by use of a plurality of electrodes or [eat pins in the unit 417, a plurality of lines can be controlled simultaneously. The range of information can be the same as that described in connection with FIG. 3, preferably one byte for each electrode or heat pin, thereby providing 256 possible variations in inking density or inking steps, obtained by differential heating and control of engagement pressure of the individual elements in the head 417.

The transfer tape 415 is guided over a plurality of deflection rollers 422 against the gravure cylinder 401, where it is held in engagement which a portion of its circumference. The image transfer unit 423 is located within the loop of the transfer tape 415, preferably including a heatable roller 424, and so mounted that its engagement pressure against the gravure cylinder 401 can be controlled, so that the engagement pressure of the transfer tape 415 likewise is controlled. Transfer of the substance from the transfer tape 415 to the gravure cylinder 401 can be carried out line-by-line or over a surface, particularly since the tape 415 can be engaged with a substantial surface region of the gravure cylinder 401. This is substantially faster than the point-by-point transfer of the initial image information from the head 417 on the transfer tape 415.

The comparatively slow recording of the information on the transfer 415 can be carried out in one step; the subsequent control of the ink transfer characteristics of the gravure cylinder 401 can be carried out much faster. This differential speed capability has substantial operating advantages in production: after the printing cylinder 401 has been controlled, the transfer tape 415 can be removed from engagement with the cylinder 401 and supplied with the image information for the next subject matter to be printed. By selecting a transfer tape 415 of suitable length, all operating shifts in a printing plant or the daily production can be applied to the tape 415 so that all printing information can be stored on one tape in advance for subsequent use, when desired.

Figure 8:
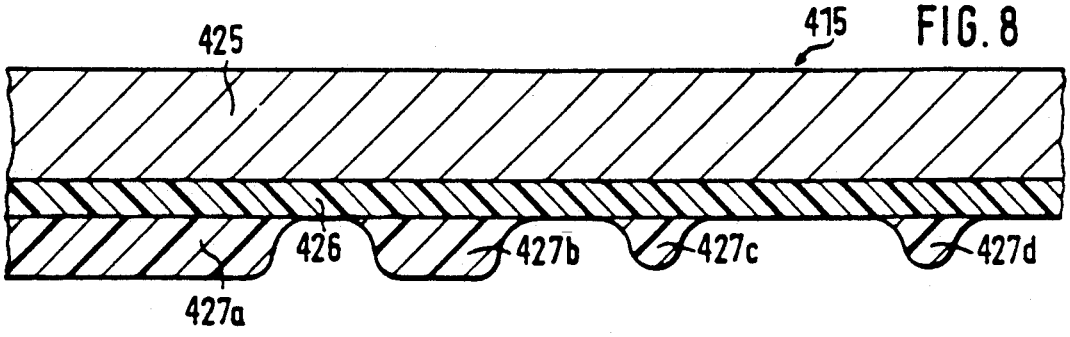
FIG. 8 is a highly enlarged schematic cross-sectional view of the transfer tape used, for example, in the system of FIG. 4.
Figure 7:
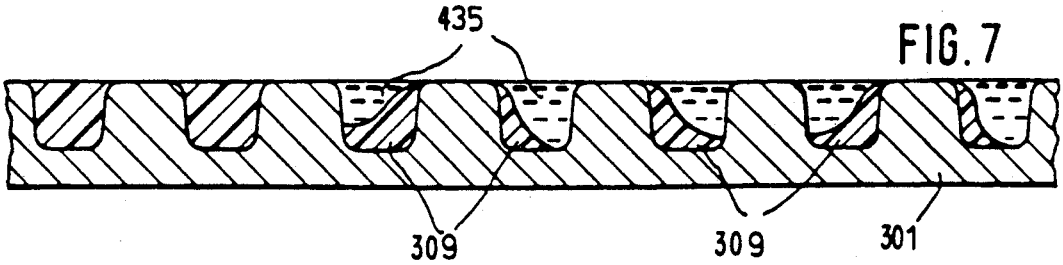

The basic arrangement of controlling ink transfer from the gravure cylinder 401 to the web W is similar to that previously described in connection with FIGS. 5 through 7. FIG. 8 illustrates, in enlarged cross-sectional view, the transfer tape 415. As seen in FIG. 8, it is formed of two layers, one carrier layer 425 which is strong in longitudinal direction, and resistant t? longitudinal stretch. This carrier layer should retain its design dimension, so that register with respect to printed subject matter is likewise retained. The previously described TEFLON layer, here layer 426 is then formed on the tape 425. Substance particles 427*a*, 427*b*, 427*c*, 427*d* . . . , and dissolved off the foil 418, are likewise shown in FIG. 8, and correspond, essentially, to the particles 27, FIG. 2*b*. They are shown in much larger scale iu FIG. 8. The transfer tape 415, similar to tape 415, is then engaged with the side carrying the particles 427*a*, 427*b* . . . against the surface of the gravure cylinder 40 and, by application of energy to the back side of the transport tape 415, the particle areas are molten and pressed into the basic receptor matrix of the gravure cylinder, where they immediately harden upon contact with the cold surfaces of the gravure cylinder, see FIGS. 5 and 6. Any remnants of substances which might extend over the surface of the receptors 307 can be easily removed by a hot doctor blade lightly scraping over the ribs 308. Upon subsequent inking, see FIG. 7, the finished gravure printing cylinder can then be readied for printing. The roller 424 is removed, the tape and the deflection rollers 422 are disengaged from the cylinder, the impression cylinder 413 is engaged against the gravure cylinder 401, and printing can commence.

The transfer tape 414 may be held in a cassette as described in connection with FIGS. 2*a*, 2*b*, and imaged by a suitable imaging unit, as described in connection with FIG. 2*a* or 2*d*, respectively, for subsequent engagement with the gravure cylinder 401.

Figure 10:
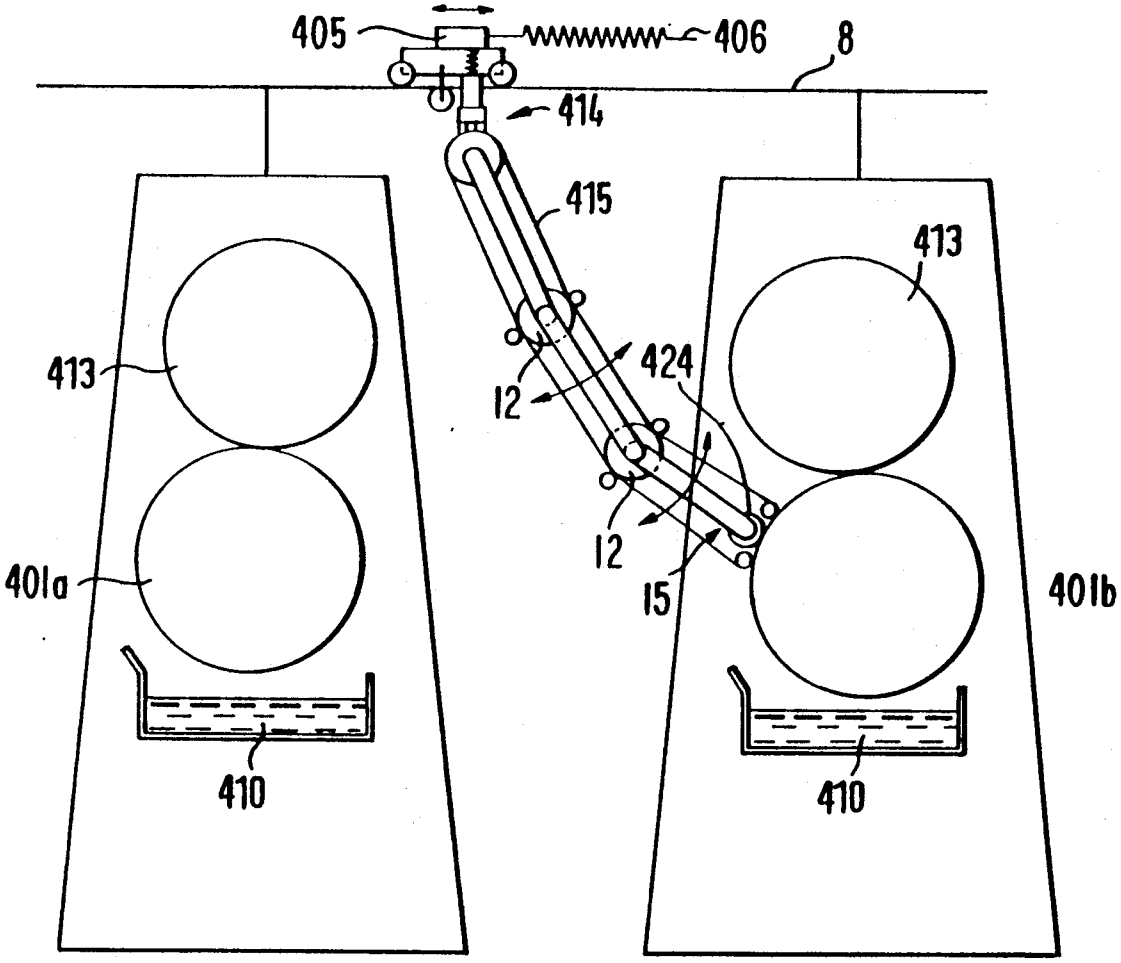
FIG. 10 illustrates another embodiment to arrange a transfer tape in conjunction with a gravure printing machine.

In accordance with a feature of the invention, the transfer tape 415 can a so be applied by a positioning robot or the like, shown schematially in FIG. 10. A carriage 405, running on a track 8 (FIG. ) and controlled via line 406, is movable, as described in connection with FIG. 1, for selective engagement against one or the other gravure cylinder 401*a* or 401*b*. Each gravure cylinder is in contact with an impression cylinder 413, for passage to a web (nor shown in FIG. 10) therebetween. The numerous links in the link portions of the apparatus ensure versatilite and free movement of the tape, for engagement with the respective gravure cylinder 401*a*, 401*b*.

The tape 415 can be prepared by use of the intermediate foil 418, of can be directly supplied with the meltable substance, as described in connection with FIG. 4*d*. Transfer of the image carrying material from the tape 415 to the respective gravure cylinder uses heated roller 424, preferably 432 to facilitate transfer of the meltable substance. Additionally, the substance can be suitable doped so that magnetic or electrostatic transfer forces can be applied thereto, as described in connection with FIGS. 2*c* and 2*f*.

Any thermoplastic material or wax is suitable as the transfer substance to be applied to the tape 415.

Figure 9:
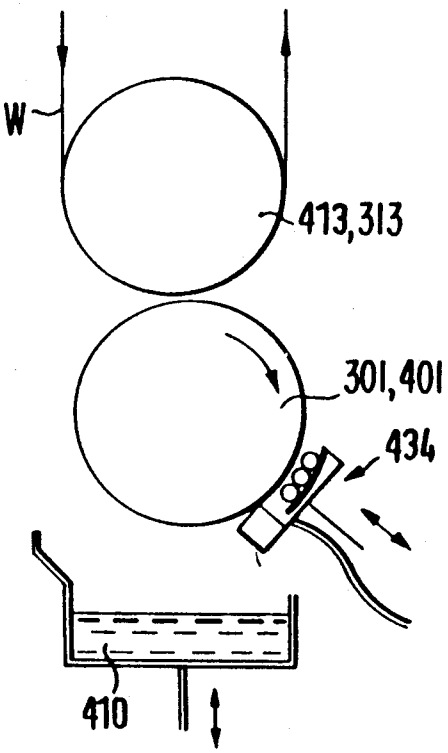
FIG. 9 is a schematic portion from a gravure printing machine, illustrating an erasing system for a gravure printing cylinder.

One of the advantages of this system is that the expensive gravure cylinders can be easily reused for different images. After finishing printing, new image material can be easily applied thereto. The gravure cylinder is cleaned to remove remnants of ink. Referring to FIG. 9: After cleaning of the cylinder, an erasing system 434 is engaged against the respective cylinder 301, 401, which supplies sufficient heat to liquefy the thermoplastic substance previously applied thereto, and then, by means of a blower and/or suction, remove the liquefied wax and/or thermoplastic material. Blotting tapes or sheets can also be used, which suck up the liquefied substance by capillary action between interstices of felting or woven or knitted blotting material.

The gravure cylinder 301, 401 preferably is made of ceramic material, which has high gear resistance and is highly resistant against heat. Such gravure cylinders have a long lifetime, and are capable of carrying many different forms of printed image, and can be easily reused with different printed subject matter. Even if the printed subject matter changes often, the high quality obtainable with gravure printing can be achieved. At the some time, wear and tear of the doctor blades 311, 411, engaged against the cylinders, is reduced when they slide on the ribs or ridges of the ceramic material.

Figure 11:
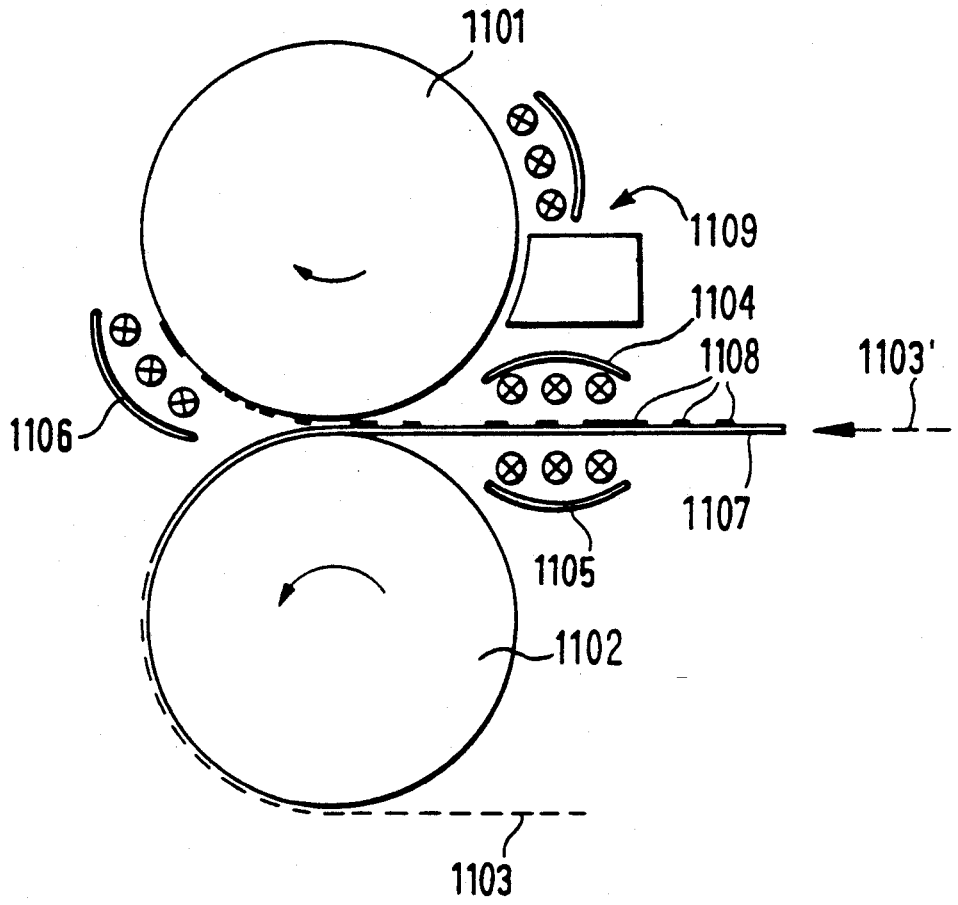
FIG. 11 is a schematic side view of a printing cylinder and illustrating application of the printing image thereto, in which the printing cylinder directly transfer the printed image to a printing substrate.

Referring now to FIG. 11, which illustrates, in enlarged scale, a printing form cylinder 1101 against which transfer tape in form of a web can be engaged. The printing form cylinder 1101 may be a gravure cylinder, like cylinder 301, 401 (FIGS. 3, 4), it may be a screen printing cylinder, or it may be a lithographic cylinder, for example adapted for direct printing, and referred to in the printing filled as a Di-Litho form cylinder. Printing by means of the printing cylinder 1101 is not illustrated in FIG. 11; the path of a substrate, on which printing is to be effected, is shown only schematically by the broken-line arrow 1103'. The printing cylinder 1101 applies Printed subject matter in accordance with inked areas on t e printing cylinder 1101.

In accordance with a feature of the invention, heater units 1104 and 1105 are located above and below the path leading towards the nip between cylinders 1101 and 1102, and as shown schematically by arrow 1103. Further heater units 1106 are located downstream of the nip, and at the run-off or run-out side of the cylinder 1101. The directions of rotation of the cylinders 1101 and 1102 are shown by the respective arrows therein.

A transfer tape 1107, which can be similar to the transfer tape or ribbon 19 (FIG. 2*b*), has substance particles 1108 placed thereon, which may, for example, be similar to the particles 27 (FIG. 2*b*). These particles are applied as known, for example, from the referenced German Pat. No. 32 48 178 or, for example, as explained in connection with FIGS. 2*a*, 2*d*, that is, for example by thermo transfer by a thermal printing head, pin electrodes, be application of a toner-like substance, spray application of molten material or the like, is discussed in connection with FIG. 1 and FIGS. 2 (collectively). The particles 1108 may, for example, be wax, a thermoplastic material, or another material which, after transfer t the transfer tape 1107, immediately cools thereon and solidifies on the tape 1107.

The transfer tape 1107 is guided in the path 1103' in the printing machine; all apparatus and devices customarily present in printing machines, for example register control systems and the like, can also be used at that time. When the tape, with the particles 1108 thereon, passes the heaters 1104, 1105, the substance elements 1108 are re-molten and as they pass through the nip, are pressed by the impression cylinder 1102, acting on the bottom side of the transfer ribbon 1107 against the form cylinder 1101, where they immediately solidify again upon contact with the cold surface thereof.

Some substance 1108 may include chemical such as softening agents solvents, and the like. The heater 1106 is provided to expel such additives, so that the substance particles 1108, then transferred to rhe cylinder 1101, reach their final strength and hardness.

The substance particles 1108 control and influence the inking of the surface of the for cylinder 1101 in dependence thereon. Differential effects can be obtained. If the cylinder 1101 is a gravure cylinder (FIGS. 3, 4), having a uniform and consistent network of receptor depressions, the receptors are filled, in part, or wholly, with the particles 1108. Upon inking, only so much ink is available as can be accepted by the partially filled receptors or cells, as discussed in connection with FIGS. 3 and 4.

The printing form cylinder 1 may, also, be a screen printing cylinder having a uniform pattern of screen openings which can be closed off by the substance particles 8 at those regions where no printing is to be effected. If the cylinder 1101 is a Di-Litho printing form cylinder of an offset printing machine, then the surface thereof is first covered with a hydrophilic coating. The particles 1108 then will mark those portions of the cylinder where printing is to be effected, by applying an oleophilic area thereon, to which the ink will adhere.

After complete transfer of the image to be printed on one or all printing cylinders 1101 of the printing machine system, the transfer tape 1107 is removed from the printing machine and a substrate 1103 can be fed thereto; if in web form, the web is threaded into the machine. After termination of printing, new subject matter can readily be applied to the printing cylinders. An erasing arrangement 1109 is then energized or activated to remove the previously applied substance particles 1108 from the cylinder 1101. Removal of these particles is readily effected by renewed heating and liquefication of the particles, which can be further assisted by applying a scraper blade against the cylinder 1101, and/or compressed air, preferably heated, or suction, there against; wiping off with cleaning solution can also be used.

Figure 12:
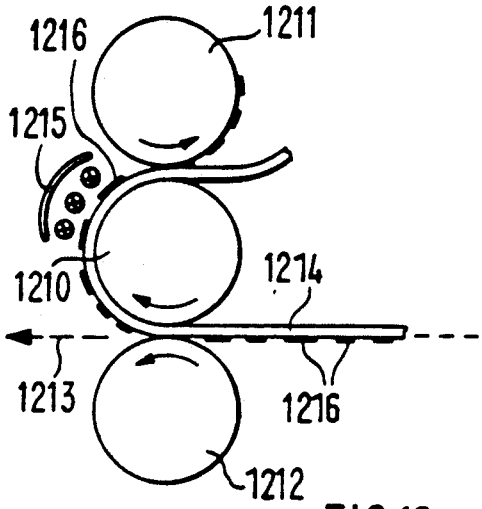
FIG. 12 illustrates direct application of an image to a planographic or offset printing machine cylinder with a different path of the substrate web than that of FIG. 11.

FIG. 12, highly schematically, illustrates an impression cylinder 1212 engageable against a rubber blanket offset cylinder 1210 which, in turn, is engageable with a plate cylinder 1211. The application of printed subject matter on the plate cylinder 1211 is the reverse of that which is carried out during printing, that is, the tape, ribbon or web 1214, with the discrete substance particles 1216 of oleophilic substance, is looped about the blanket cylinder 1210 for transfer of the subject matter then to the plate cylinder 1211. The inkers and dampers, used for printing, have been omitted from the drawing, since they are not material to carry out the transfer of subject matter. For printing, the path shown by the broken-line arrow 1213 is the one through which a printed web would pass between the impression cylinder 1212 and the blanket cylinder 1210.

To apply a printing image on the plate cylinder 1211, the transfer web, belt, tape or ribbon 1214 is introduced in the path usually taken by the printed subject matter, then, with the printed information away from the offset cylinder, and after passing the gap between the blanket cylinder 1210 and the impression cylinder 1212, the transfer belt is deflected from the path 1213 and, rather, wrapped about the blanket cylinder 1210. The blanket cylinder, in this embodiment, preferably has grippers which are well known and customary on sheet offset printing machines. The grippers, preferably laterally located, hold the ribbon or web or belt 1214. A heater 1215 directs heat on the transfer element 1214 so that the oleophilic substance particles 1216 will melt. By pressure of the blanket cylinder 1210 on the back side of the transfer element 1214, the liquefied or soft substance particles 1216 are pressed against the plate cylinder 1211 upon passing the nip between the plate cylinder 1211 and the blanket cylinder 1210, to harden immediately upon contact with the cold surface of the plate cylinder 1211. The substance particles, due to their oleophilic characteristic, will then mark those image transferring portions on the surface of the plate cylinder 1211 which are to print; the remainder surface is hydrophilic and ink-rejecting.

A printing cylinder, so programmed or imaged, can be easily reconstituted for re-imaging with a different subject matter later, similar to the way described in connection with the embodiment of FIG. 11, by applying an erasing system, which may include heaters, washing liquids and/or solvents, similar to system 1109 (FIG. 11) applied against the plate cylinder 1211.

Figure 13:
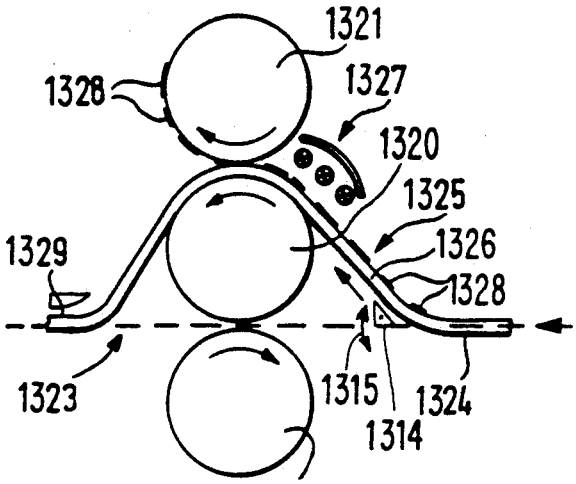
FIG. 13 illustrates a modification of the path of the transfer tape.

FIG. 13 illustrates, schematically, a configuration which is similar to the structure of FIG. 12, namely showing an impression cylinder 1322, a web path 1323, a blanket cylinder 1320, and a plate cylinder 1321. The image transferring belt, web, tape or other element 1324 is guided by means of a deflectable switch 1314 in a path 1325 to the gap between the printing form or plate cylinder 1321 and the blanket cylinder 1320. The position of the switch 1314 will depend on the mode of operation of the offset printing machine. For imaging the plate cylinder 1321, the position of the switch 1314 will be as shown in FIG. 13. For printing, the switch 1314 is moved downwardly, as shown by the double arrow 1315, so that a web of substrate material can take the path shown by the broken line 1323 between the blanket cylinder 1320 and the impression cylinder 1322. The transfer tape 1326, for imaging, is guided in the path 1325. A heater 1327 heats the image carrying substance portions or particles 1328 which are pressed by the blanket cylinder 1320 against the cold printing form cylinder 1321, where they immediately solidify upon contact with its cold surface. The transfer belt, tape or web 1326 can be guided again on the path 1323 by a subsequent guide element 1329, so that the branch 1325 of the tape 1326, within the region of the printing system, forms a complete bypass to the normal printing web path 1323.

Figure 14:
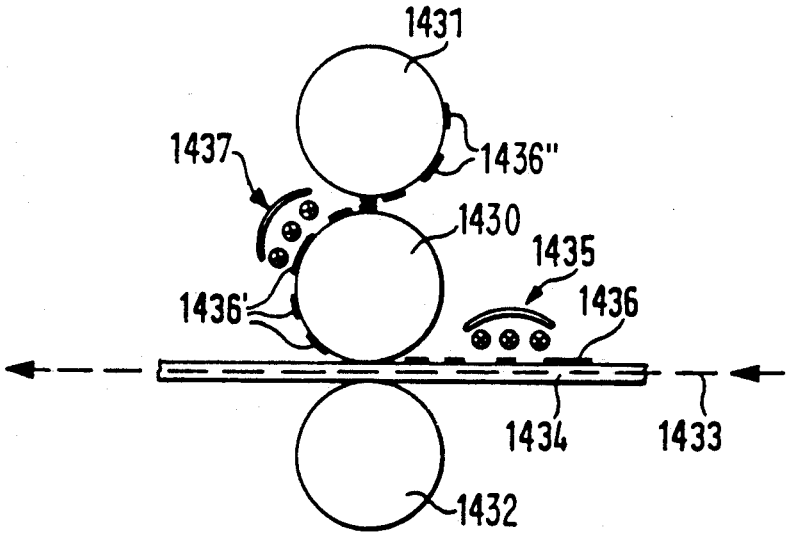
FIG. 14 illustrates direct imaging of an offset plate cylinder with an intermediate transfer step via the blanket cylinder.

FIG. 14 illustrates another embodiment in which, highly schematically, printing unit of a rotary offset printing machine is shown, which has a blanket cylinder 1430, an impression cylinder 1432, and a printing form or plate cylinder 1431. The path of the web upon printing is shown in broken lines at 1433. To provide for imaging of the printing form cylinder 1431, a tape or web with oleophilic substances is passed in the same web path 1433, taken by printed substrates. The tape or web 1434 can be an elongated element, as described in connection with the embodiments of FIGS. 1 and 2 (collectively), except that it probably will not be retained in a cassette. A heater 1435 melts the heat affectable transfer substances 1436 of the transfer tape 1434 which, as they pass the gap between the impression cylinder 1432 and the blanket cylinder, are pressed against the blanket cylinder. The blanket cylinder 1430 has a cold surface and the molten particles immediately solidify to form the particles 1436' on the blanket cylinder 1430. The blanket cylinder, thus, acts as what might be called a reverse offset cylinder; in a second transfer step, the substance portions 1436' are heated by a second heater 1437, and the molten particles are transferred to the cold surface of the plate cylinder 1431, where they will be deposited and adhere in the form of the particles 1436''. The solidified particles 1436 are oleophilic and, in combination with the otherwise hydrophilic surface of the plate cylinder 1431, will form the ink carrying portions of the printing form cylinder 1431.

The blanket and form cylinders 1430 and 1431 can be cleaned, to accept another and different image, as described in connection with FIG. 11.

Basically, the system permits use of existing cylinders and elements in an offset printing machine, by generating the image to be printed by selecting, insofar as possible, a reverse path of the ink carrying and controlling substances.

The heat affectable substance particles 1108, 1216, 1328, 1436 are shown in substantially enlarged and exaggerated representation in FIGS. 11 to 14 for ease of illustration. Actually, they will be tiny dots, corresponding to printed image information.

When using thermo transfer tape, see for example FIGS. 1 and 2, and particularly when transferring tiny or point areas which are dissolved from the thermo transfer tape, difficulties may arise with respect to sharpness of the image being transferred due to tolerances, and variations in contact between thermal electrodes or heater elements of a thermo printing head, and the surface on which the material is to be transferred. Already small deviations in dimensions may interfere with the effective engagement pressure, and thus heat transfer, and hence melting of the heat affectable substance, so that the image to be transferred may be non-uniform or result in transferred image elements which are poorly adhered to or anchored on the printing cylinder on which it is to be placed.

Figure 15:
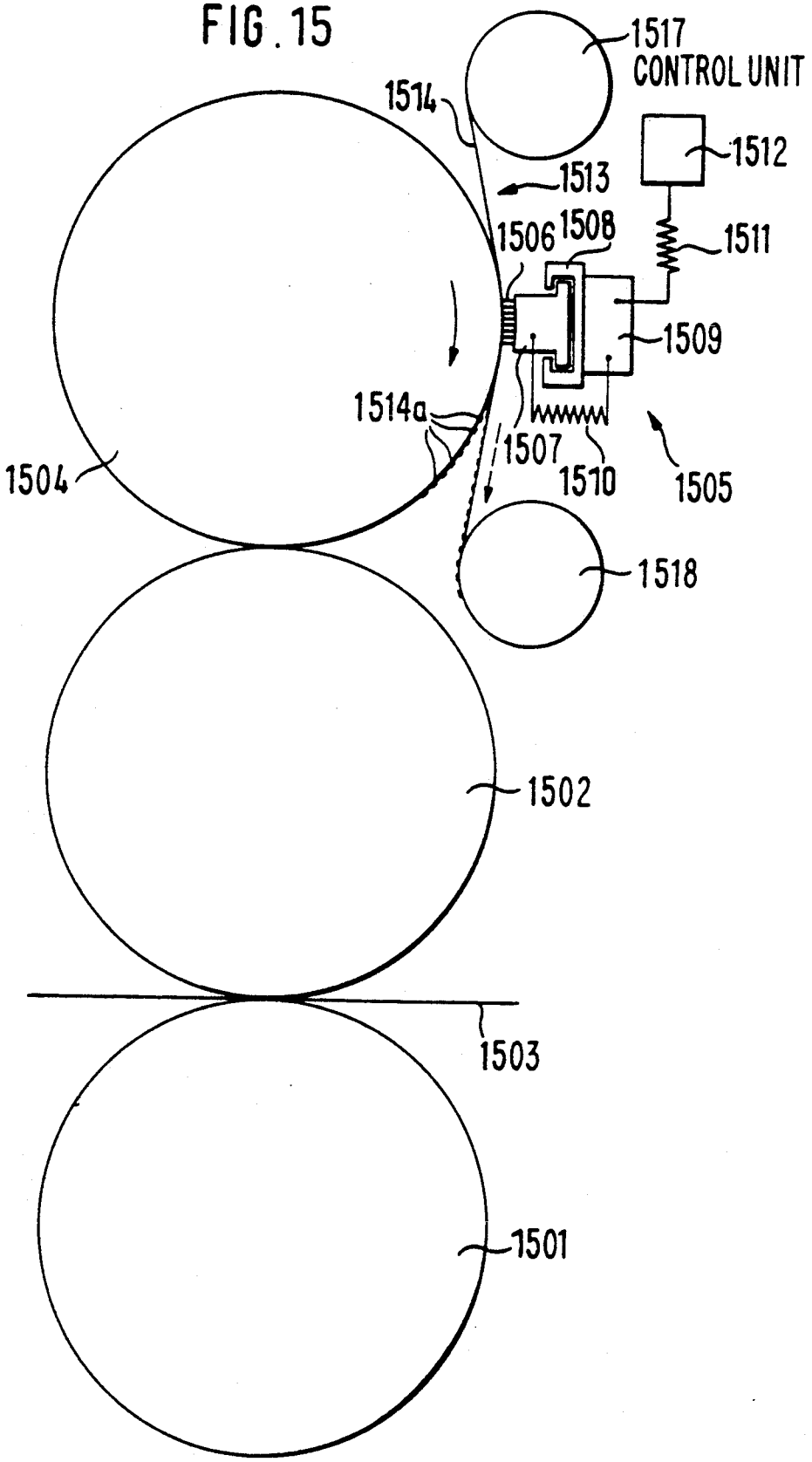
FIG. 15 illustrates direct imaging of a printing cylinder in a single transfer step.

In accordance with a feature of the invention, a soft, or elastic, that is, a yielding, pressure deformable surface is used as a counter element for the thermo transfer tape so that variations in linearity, engagement pressure and the like can be compensated. FIG. 15 illustrates a printing system similar to that described in connection with FIGS. 11–14, in which an impression cylinder 1501 is located opposite a rubber blanket cylinder 1502. During printing, a web 1503 can be passed between the impression cylinder and the blanket cylinder 1502 A printing form cylinder 1504 carries the printed image, which is transferred to the blanket cylinder 1502, as well known in offset printing.

In accordance with a feature of the invention, and to provide a back-up for a thermo tape or web 1513, the plate cylinder 1504 has a yielding surface which is at least somewhat elastic and preferably has an elastic sleeve, coating or the like thereon which also, preferably, is hydrophilic. Suitable materials for the yielding surface of the plate cylinder 1504 are acrylic esters, rubber, nitrile rubber, or modified polyvinylchloride (PVC), all of which are pressure deformable.

The image transfer unit 1505 includes a plurality of heatable thermo pins or elements 1506, forming part of a thermo recording head 1507. The thermo head can extend axially across the cylinder 1504 or can travel parallel to the circumference, axially, along the cylinder 1504 in a suitable guide track 1508. A control unit 1509, coupled to the print or recording head 1507, provides suitable energy to the pins 1506 via a connecting cable or line 1510. A control unit including an image memory 1512, connected via line 1511 to the control element 1509, provides image generating information to the print head 1507.

The thermo transfer foil, web, ribbon, tape or belt 1513 is located between the heater pin elements 1506 of the thermo print head 1507 and the form cylinder 1504. A solid substance 1514 is applied to the surface facing the form cylinder 1504 which has the characteristics that it is solid at room temperature, but can be melted upon influence of heat by the electrodes 1506. The substance is oleophilic, that is, ink-accepting; a thermoplastic or wax are suitable. The thermo transfer foil 1513 is supplied from a supply reel 1517 and the used foil is taken up by a take-up reel 1518. The thermo transfer foil 1513 is engaged against the form cylinder 1504 together with the printing head 1507 in such a manner that the surfaces of the foil 1513 and the form cylinder 1504 are in engagement over a portion of their circumference.

In operation, portions of the coating 1514 are transferred from the foil 1513 on the form cylinder 1504 where they will form, in accordance with the image, solidified particles **1514*a*. Initially, the control element 1509 transfers from the control unit 1512 and the memory thereof digitally stored image information to any one of the electrode pins 1506, and activates those electrodes which are to transfer ink, leaving those inactive which are not to transfer ink. Thus, respectively, elements 1506 are selectively energized and those elements, if an image point should carry ink, will be heated and the energy can be transferred to the thermo foil 1513 to melt incremental areas thereof. The energy can be used directly as heat energy in heater elements 1506 or the elements 1506, if formed as pin electrodes and cooperating with electrical resistance layers on the foil 1513, can be liberated by the resistive-ribbon method. Application of energy to the foil 1513 will melt small areas and the molten substance particles 1514*a* will adhere to the surface of the form cylinder 1504** where they will solidify rapidly on the cold cylinder.

Since the surface of the form cylinder 1504 is elastic, and soft, the tolerances of the thermo printing head 1507 need not be very high; likewise, the guide track 1508 and the operating conditions of the overall system, including engagement pressures, transfer of energy and the like, are subject to reasonable variations.

Transfer of particles of the coating substance on the thermo tape 1513 can be carried in parallel over a plurality of lines, by using a plurality of heater elements 1506, or pin electrodes, if the tape itself includes a resistive layer. The feed of the print head 1507, as well as rotation of the form cylinder 1504, can be controlled by the control unit 1515 and/or the head unit 1509 after transfer of one or more lines of images, singly or in parallel. FIG. 15 illustrates a plurality of circumferentially located pin elements 1506 for transfer, simultaneously, of the plurality of point-like image representations, across a plurality of lines.

Figure 16:
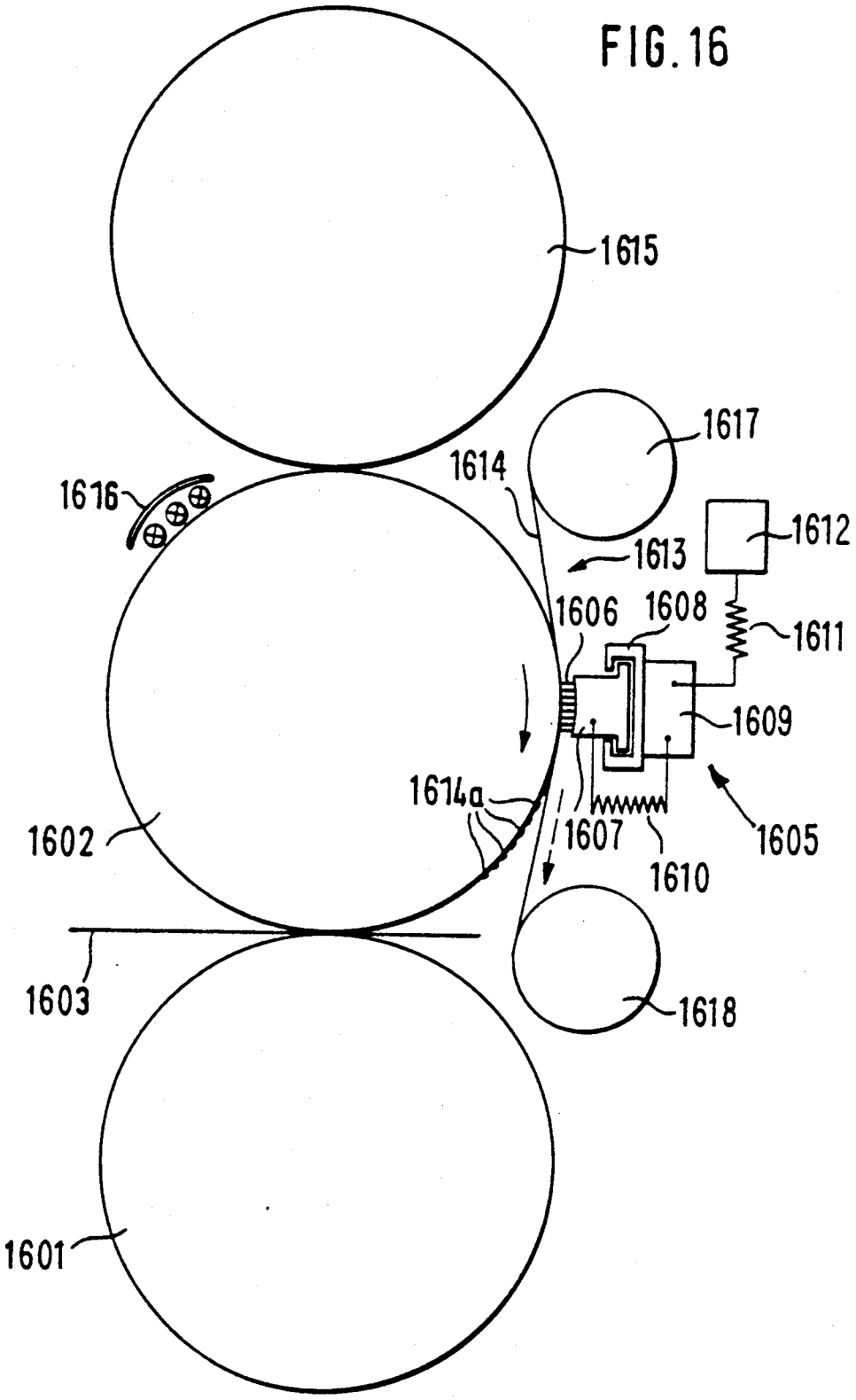
FIG. 16 illustrates a modification of the method and system of FIG. 16, with an intermediate transfer step.

Referring now to FIG. 16, in which all elements similar to those described in connection with FIG. 15 have been given the same 10 and unit digit reference numerals The image transfer head 1605 is engaged against the blanket cylinder of a rotary offset printing machine system, having an impression cylinder 1601, a blanket cylinder 1602, and a plate cylinder 1615. The path of a substrate is shown at 1603. The substance portions or elements **1614*a* are removed from a thermo transfer foil 1613 and transferred to the soft or resilient surface of the blanket cylinder 1602. A heater 1616 is located just in advance of the nip between the contact line of the blanket cylinder 1602 and the plate cylinder 1615 so that the elements 1614*a*, which have solidified after transfer from the transfer tape 1613, are again molten and can be transferred in a second transfer step to the plate cylinder 1615. The soft surface of the blanket cylinder 1602 can be engaged against the hard surface of a standard form or plate cylinder 1615, so that any tolerances in the transfer from the thermo tape 1613 by the thermo head 1605** can be compensated.

The plate cylinder 1504 as well as 1615 of FIGS. 15 and 16, and the blanket cylinders 1502 and 1602, preferably, are circumferentially continuous, that is, are in sleeve form without a seam or clamping interruption.

Various changes may be made in this arrangement as well and, rather than using a printing head 1505, 1605, as shown, which is operable in a track 1508, 1608, a head may be used which extends axially over the entire width of the cylinder or one which extends over the width of the thermo transfer foil or tape 1613, for simultaneous or shortly sequential transfer of point information by the individual print elements 1606 in single or multiple line form.

Figure 17:
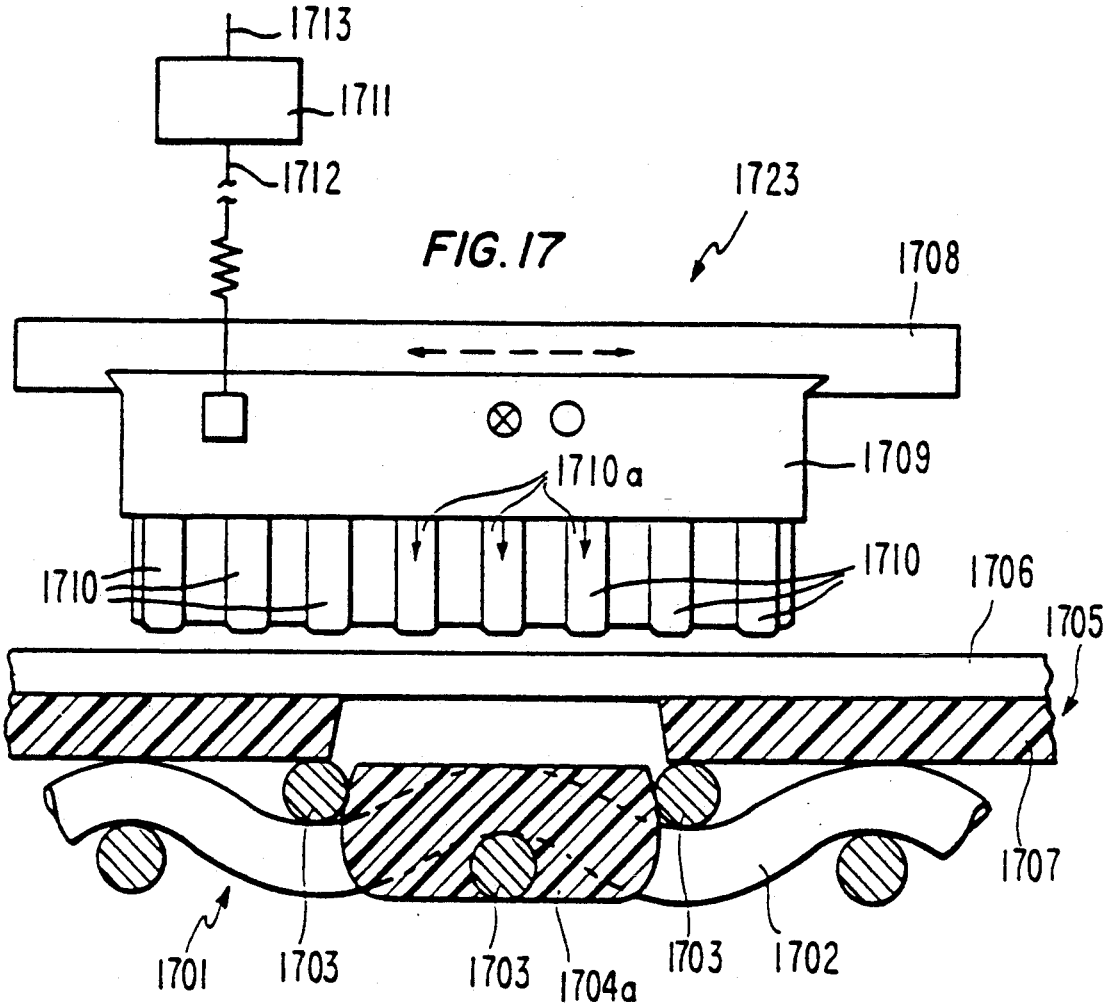
FIG. 17 is a highly schematic side view of imaging a screen printing element by a transfer tape.
Figure 18:
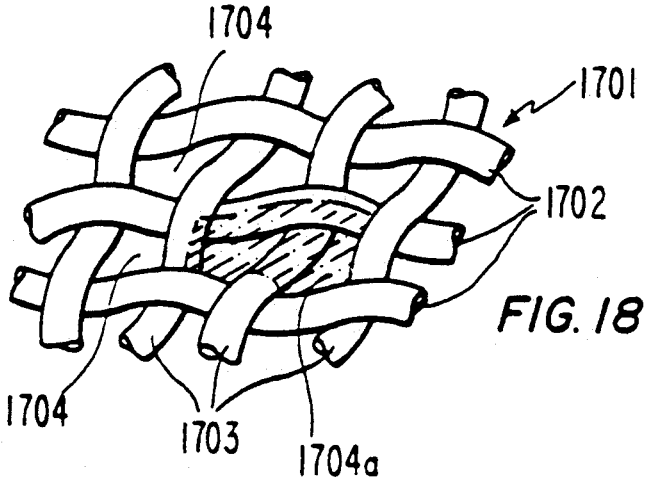
FIG. 18 is a schematic pictorial view of the resulting screen material.

The invention has been described with reference to planographic printing (FIGS. 1 and 2) and gravure printing (FIGS. 3, 4). Other printing systems may be used. FIG. 17, highly schematically, shows a vertical part-sectional view through a system using the concept of the present invention and applied to screen printing, a pictorial representation of the result of application of the invention to a printing screen being shown in FIG. 18.

A printing screen 1701 (FIG. 17) has longitudinal or warp filaments 1702 and transverse or weft filaments 1703. The filaments or threads or yarns 1702, 1703 form solid portions, leaving openings 1704. A thermo transfer foil 1705, for example similar to the foil 19 (FIG. 2*b*),is placed on one side of the screen 1701. The thermo transfer foil 1705 has a support or carrier layer 1706 and, at the side facing the screen 1701, a layer of a meltable substance 1707, as previously described, for example a thermoplastic, a wax or the like.

The thermo printing head 1709 can run in a track 1708, movable in the plane of the drawing, fitted with several individual thermo elements 1710. A control unit 1711 controls movement of the printing head 1709, as well as energization of the heating element 1710 via a flexible connecting line 1712. The thermo head 1709 and the control unit 1711, together with the thermo transfer foil, web or belt, form an image transfer unit 1723, together with transport rollers, deflection rollers, and the like, not shown, and placed and arranged as required by the nature of the respective elements. The control unit 1711 is coupled by an electrical control bus 1713 with an electronic memory, for example similar to the image memory M (FIG. 2*a*), which provides digitally stored image information. Each opening 1704 of the screen 1701 thus can, selectively, be commanded to transfer ink, or not to transfer ink, in accordance with command bits stored in the memory. The control unit 1711 controls the movement of the printing head 1709 and, if at any one position of the finished screen print no ink is to be applied, one or more thermo elements 1710 are energized. The so activated elements 1710*a* (FIG. 17) melt the meltable substance 1707 in a locally precisely limited region, so that the molten substance can penetrate into the openings of the mesh of the printing screen, where it will immediately solidify and close off the openings, as shown schematically at 1704*a*.

The thermo printing head then moves along the track 1708 and, point-by-point or line-by-line closes those mesh openings 1704 which are not to print, that is, forms more regions 1704*a*. After any line, either the print head 1709, together with the track 1708, or the screen print form 1701, is indexed in the direction of the warp or longitudinal filaments by one or more line steps, Eight heater elements 1710 can generate eight image lines, in parallel, as shown for example in FIG. 17 and, in such an arrangement the line feed, after making the respective lines, can also be in steps or eight lines. Information transfer through the connecting lines 1712, 1713 can be bit-by-bit, serially, or when using for example eight thermo units 1710, in 8-bit parallel. By use of appropriate signal processors, memories, and data buses, information transfer can, of course, also be carried out in greater width, for example 32-bit parallel, which then permits controlling a correspondingly larger number, e.g. 32 heater elements 1718.

Figure 19:
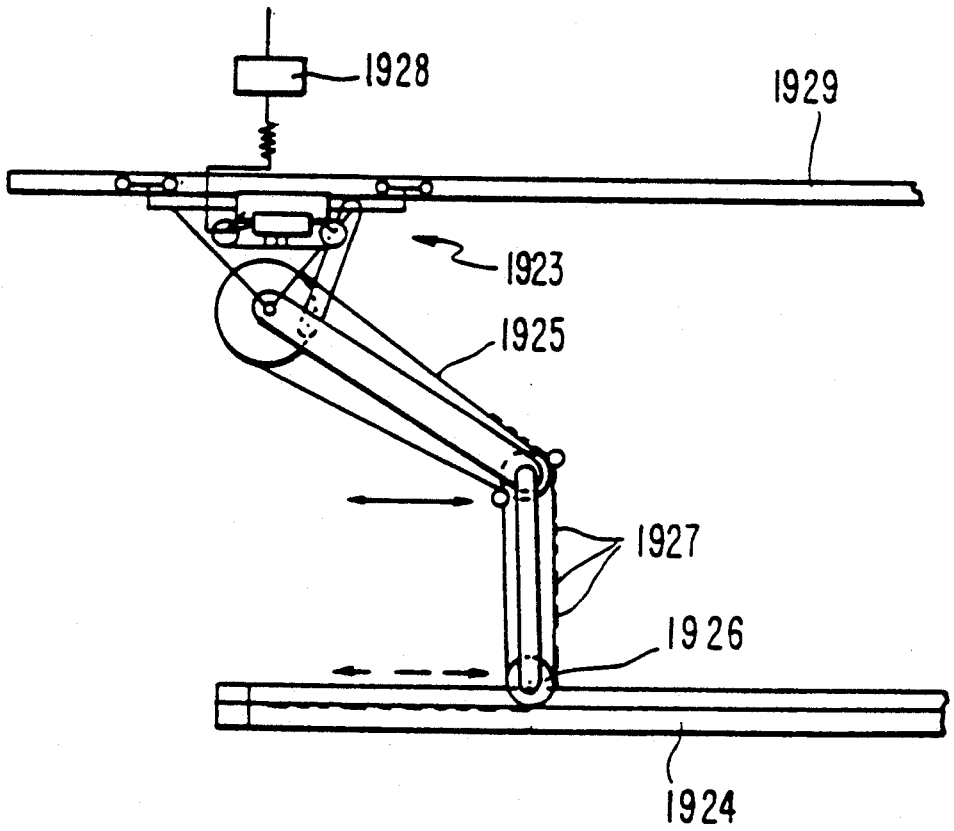
FIG. 19 illustrates application of image information from a transfer tape to a flat printing screen.

FIG. 19 illustrates an arrangement in which a transfer tape or belt 1925 is interposed so that complete image representations, in the form of point or incremental area substance portions which were molten and re-solidified can be stored; the system is applicable independently of the substance used for melting and solidifying in the point-by-point image transfer unit 1923, corresponding to the head 1723 of FIG. 17, and is able to properly control a screen printing form 1924. The transfer unit 1926, preferably located at the end of the transfer tape, foil or belt 1925, includes a heatable roller 1926 so that, by application of thermal energy, the tiny substance elements 1927 on the transfer foil or belt 1925 are deposited on the screen 1924, to again obtain the arrangement shown in FIG. 18. The head with the heated roller 1926 can apply the substance elements 1927 line-by-line, or over a predetermined area.

The transfer belt or foil 1925, the thermo head and transfer unit 1923, and the associated control unit 1928 can be combined in a single carriage movable along a guide track 1929. This has the advantage that the slow, point-by-point or line-by-line generation of the transfer tape 1929 with the substance particles 1927 thereon, can be separated from the much faster process of transferring the particles 1927 to the screen 1924 by the head 1926. Thus, the belt, foil or tape 925 can be prepared while a screen is printing, and a new screen 1924 can be programmed for printing at a much higher speed than the generation of the belt, foil or tape 1925. Further, a single unit as shown in FIG. 19 can program a plurality of screen printing forms at suitable locations coordinate with the track 1929.

The information applied on the screen 1701 or 1924, respectively, can be easily erased. After printing, the screen is cleaned and any remnant ink particles are removed. The screen is then heated and the liquefied particles of the substance 1707 or particles 1927, are removed by blowing off with hot air, wiping, or the like. Thus, a single screen print form, as well as the substance, which can readily be recuperated, can be re-used as often as desired, thus substantially improving the economics of operation, as well as reducing waste and trash which may have to be removed. All elements used in the process, thermo foil 1705, the thermally affectable coating 1707, the transfer foil 1925, as well as the screen 1701, 1924, itself, can all be reused and recycled.

Various changes and modifications may be made, and any features described herein with respect to any embodiment and feature of the invention may be used with any other, within the scope of the inventive concept.

We claim:

1. A method of applying a printed image on a printing machine form (4, 18) of a printing machine, in accordance with image information, provided by an electronic control unit (22), wherein said printing machine form comprises a surface element having ink applying surface portions and non-inking surface portions for subsequent transfer of printing information unto a substrate (W, 1103) receiving said printed information, comprising the steps of passing a transfer tape (10, 19, 415, 1107, 1214, 1513, 1706) past a recording head (9, 17, 414, 1507, 1709) controlled by said control unit (22), wherein the transfer tape has a substance on a surface thereof which is subject to change of characteristics under influence of energy applied thereto by said recording head, and wherein said change in characteristics affects the affinity of, respectively, water and printing ink of the surface of said transfer tape;

applying energy to the recording head in accordance with the image information provided by said electronic control unit (22) in line form, to apply to said transfer tape a pattern of changed characteristics representative of said image information;

passing said transfer tape with said image information thereon to a reproducing means (16, 25, 424, 1104, 1105, 1926);

arranging said reproducing means for direct operative association with said printing machine form (4, 18), with said transfer tape interposed between the reproducing means and the printing machine form and applying energy to said reproducing means to transfer the substance with its characteristics controlled in accordance with the image information from said transfer tape onto said printing machine form (4, 18).

2. The method of claim 1, wherein said step of applying energy to said recording head comprises applying energy thereto along a plurality of sequential lines, to generate a surface image before passing said transfer tape to the reproducing means; and wherein said step of supplying energy to said reproducing means comprises applying energy to said reproducing means sufficient to transfer the plurality of lines of the substance to said printing machine form.

3. The method of claim 1, wherein the substance comprises a meltable substance and the change in characteristics comprises melting said substance at discrete points, spots or areas whose location is controlled by said control unit (22) by local application of energy.

4. The method of claim 1, including the step of relatively moving said recording head and said transfer tape across a lateral dimension of said tape.

5. The method of claim 1, wherein said step of applying energy to said recording head comprises applying said energy point-by-point on said transfer tape, while the transfer tape is indexed, in line-by-line steps, to provide, on said transfer tape, a representation pattern of said image information, and continuing said application of energy until said transfer tape will carry a block of information corresponding to information to be printed by said printing cylinder upon rotation of said printing cylinder about at least a portion of its circumference;

and wherein said step of applying energy to said reproducing means comprises transferring enough information from said transfer tape to the printing cylinder for transferring said block of information obtained from said control unit (22)

6. The method of claim 1, wherein said printing machine includes a plurality of printing cylinders (4, 18, 401*a*, 401*b*) and said step of engaging said reproducing means comprises engaging said reproducing means against a selected one of said plurality of printing machine cylinders, each cylinder defining a printing form.

7. The method of claim 6, further including the steps of disengaging said reproducing means from said selected printing machine cylinder (4, 18, 401*a*, 401*b*);

printing the transferred image by said printing cylinder on a substrate (W); and, while said printing machine cylinder is printing, carrying out said steps of passing the transfer tape past the recording head and applying energy to said recording head to record on said transfer tape image information in accordance with blocks of image information from said control unit (22) different from the image information which had been applied to the printing machine cylinder which is then printing.

8. The method of claim 1, wherein said printing machine comprises a plurality of printing machine cylinders;

wherein said steps of engaging the reproducing means and applying energy to said reproducing means are carried out with respect to a selected one of said printing cylinders; and further including the steps of printing on a substrate web (W) by said selected one printing cylinder; and while said selected printing cylinder is printing, carrying out the step of passing said transfer tape to a reproducing means, engaging said reproducing means and applying energy to said reproducing means with respect to another printing cylinder of said plurality of cylinders, each cylinder defining a printing form.

9. The method of claim 1, further including the step of erasing the image information carried by said printing form after having carried out said step of applying energy to said reproducing means (16, 25), said erasing step comprising removing said transferred substance from said form by at least one of:

heating of said form;

chemically dissolving said substance from the circumference of said form;

mechanically removing said substance from the surface of said form.

10. The method of claim 1, wherein said printing machine comprises at least two printing machine cylinders (1101, 1103; 1210, 1212, 1320, 1322, 1430, 1432) defining, at least in part, a printing path for a printing web (1103, 1213, 1323, 1433);

and wherein said step of passing said transfer tape, with said image information, to a reproducing means comprises passing said transfer tape at least in part in said predetermined path of the web and in engagement with one of said cylinders, and said reproducing means includes means for applying energy to said transfer tape, and a portion of said one cylinder, as the transfer tape and said one cylinder are moving for transfer of said substance to said one cylinders.

11. The method of claim 10, wherein said step of passing the transfer tape to the reproducing means comprises passing said tape entirely in said predetermined path.

12. The method of claim 10, wherein one of said cylinders defining, at least in part, said predetermined path comprises a gravure cylinder, and said step of applying energy to said reproducing head comprises applying energy to said reproducing head to transfer the substance controlled in accordance with image information to the receptors or cells of the gravure cylinder.

13. The method of claim 1, wherein the printing machine form comprises a Di-Litho printing form cylinder, and said step of applying energy to said reproducing means includes transferring said substance controlled in accordance with the image information onto said Di-Litho form cylinder.

14. The method of claim 10, wherein one of said cylinders is a screen printing cylinder, and said step of applying energy to said reproducing means comprises transferring the substance in accordance with image information to the mesh of the screen cylinder.

15. The method of claim 10, wherein said printing machine comprises an offset printing machine having an impression cylinder (1212), a blanket cylinder (1210) and a plate cylinder (1211), said blanket cylinder and said impression cylinder defining, at least in part, a predetermined path (!213) of the printing web;

wherein said step of passing the transfer tape comprises passing the transfer tape about the blanket cylinder and said energy application step comprises applying energy to said transfer tape as it is being passed about the blanket cylinder to transfer the information thereto;

and including the further step of applying energy to the so transferred information on the blanket cylinder for re-transfer of the substance to the plate cylinder (1211).

16. The method of claim 10, wherein the printing machine comprises an offset printing machine having a blanket cylinder (1320), a plate cylinder (1321) and an impression cylinder (1322), said blanket cylinder and impression cylinder defining, conjointly, the predetermined path (23) of a substrate web;

and including the step of deflecting said tape (1325) from said predetermined path into a path partly in said predetermined path and being looped about a portion of said blanket cylinder (1320), and then redirecting said tape into said predetermined path.

17. The method of claim 1, wherein the printing machine form includes a screen printing form;

and wherein said step of applying energy to said reproducing means comprises transferring the substance, in accordance with the image information, from said transfer tape onto the screen printing form.

18. The method of claim 17, further including the step of mechanically reinforcing the substance transferred to the screen printing form by applying a material having the characteristic of hardening or curing or reinforcing said substance applied to the screen printing form.

19. The method of claim 17, further including the step of erasing the image information from said screen printing form by carrying out the steps of:

cleaning said form;

liquefying said substance;

and removing said liquid substance by at least one of: compressed air; suction; application of a blotting substance; wiping; scraping.

20. The method of claim 1, wherein said transfer tape is of yielding material compressible transversely to its thickness.

21. The method of claim 1, wherein the printing machine form comprises a gravure form having receptor depressions or cells on a circumference thereof;

and wherein said step of applying energy to said reproducing means comprises transferring said substance in accordance with image information to the cells of the gravure form.

22. The method of claim 1, wherein the step of passing said transfer tape with said image information thereon to a reproducing means is carried out at a speed which is higher than the speed of passing the transfer tape past the recording head.

23. The method of claim 1, wherein said transfer tape (10, 19, 415, 1107, 1214, 1513, 1706) has a surface which is pressure deformable or yielding.

24. The method of claim 1, wherein said printing machine form is a gravure printing form (305, 421), said gravure form including receptor depressions or cells for the reception of ink therein in dependence of the quantity of ink to be transferred to a printing substrate (W), said cells having a depth sufficient to accept the maximum quantity of ink to be transferred to said printing substrate;

wherein said substance on the surface of the transfer tape comprises a selectively liquefiable and solidifiable substance (**427*a*–427*d***);

and wherein said step of applying energy to said reproducing means to transfer said substance onto said printing machine form (305, 421) comprises transferring said substance from said transfer tape onto the receptor depressions or cells to thereby introduce said substance into said receptor depressions or cells.

25. The method of claim 24, wherein said step of applying said substance onto said tape comprises spraying said substance by a jet spray head (304) on said transfer tape (415).

26. The method of claim 24, wherein said step of applying said substance to the gravure form (305, 421) comprises transferring said substance by thermal action from said transfer tape.

27. The method of claim 24, further including the step of stripping excess substance off the surface of the gravure form by a heated doctor blade (311).

28. A method of applying a printed image on a printing form of a printing machine, in accordance with image information provided by an electronic control unit (22) comprising providing a carrier element (10, 19, 1504, 1602);

providing a yielding or pressure deformable surface on said carrier element; and applying meltable substance particles which affect the surface of said carrier element with respect to affinity of, respectively, water and printing ink, by a thermo transfer process under control of a recording head (9, 17, 1507, 1607);

wherein said step of applying said substance particles comprises applying said particles onto said yielding or pressure deformable surface.

29. The method of claim 28, wherein said step of transferring the particles to the yielding, or pressure deformable surface comprises transferring the particles to a transfer tape which is yielding, or pressure deformable in a direction transverse to its thickness.

30. The method of claim 28, wherein said step of applying said particles to a surface which is yielding, or pressure deformable comprises applying said particles to a printing form cylinder (1504) of the printing machine.

31. The method of claim 30, wherein said printing form cylinder has a surface comprising at least one of:

acrylic ester rubber:

nitryl rubber;

modified polyvinylchloride (PVC).

32. The method of claim 30, wherein the surface of said form cylinder is continuous and seamless.

33. The method of claim 28, wherein said step of applying the particles on the carrier element with the yielding, or pressure deformable surface comprises applying the particles on a transfer cylinder (1602), and then transferring the particles from the transfer cylinder to a printing machine printing form cylinder.

34. The method of claim 33, wherein said transfer cylinder comprises a rubber blanket cylinder (1602) of the printing machine.

35. The method of claim 34, wherein the rubber blanket of the rubber blanket cylinder is circumferentially smooth and seamless.

36. A system for applying a printing image on a printing machine form (4, 18) in accordance with image information, wherein said printing machine form comprises a surface element having ink applying surface portions and non-inking surface portions for subsequent transfer of printing information unto a substrate (W, 1103) receiving said printed information, said system comprising a recording head (9, 17, 414, 1507, 1709);

a reproducing means (16, 25, 424, 1926);

an electronic control unit (22, 305, 421, 1512, 1612, 1711, 1928) coupled to said recording head;

a movable transfer tape (10, 19, 415, 1107, 1214, 1513, 1706) having a surface including a transfer substance which is subject to change of characteristics under influence of energy applied thereto, which change of characteristics affects the affinity of, respectively, water and printing ink to the surface to which it is applied, said transfer tape past the recording head for transfer of said substance onto said transfer tape in accordance with said supplied image information, means for guiding said transfer tape past the reproducing means (16, 25, 424, 1926), said guide means further guiding said transfer tape in engagement with said printing form, with said transfer tape between the printing form and the reproducing means, said reproducing means applying energy in line or surface form to the transfer tape for transfer of said substance form the transfer tape directly onto the printing form.

37. The system of claim 36, including movable support means (8, 12, 13, 14) movably supporting the transfer tape for selective positioning of the transfer tape against the printing form or away therefrom.

38. The system of claim 37, wherein said recording head comprises a liquid jet point recorder, and said substance comprises a meltable substance, ejected by said jet recorder on the transfer tape, and solidifying on the transfer tape.

39. The system of claim 36, wherein said transfer tape is an endless tape.

40. The system of claim 36, wherein said transfer tape is independent of the printing form;

and a holder cassette (30) retaining said transfer tape therein.

41. The system of claim 36, wherein said substance comprises a selectively meltable and solidifiable substance;

and wherein said recording head comprises a thermo transfer printing element, including a thermal print foil or tape or web (!!) positioned between said transfer tape for transfer of substance from said foil or web (11) under influence of heat energy applied to said recording head to said transfer tape (10, 19).

42. The apparatus of claim 36, wherein said substance comprises a toner substance;

and wherein said recording head (9, 17; 20') applies a charge pattern on said transfer tape, in accordance with the image information provided by said electronic control unit (22), said toner substance being applied to said transfer tape to form the substance on the transfer tape for subsequent transfer to said printing form.

43. The apparatus of claim 36, wherein said transfer tape has a surface carrying said substance, and said surface comprises polytetrafluoroethylene (PTFE).

44. The system of claim 36, wherein said transfer tape comprises material which is compressible or soft or yielding in the direction transverse to its thickness.

45. The system of claim 36, wherein said reproducing means comprises a heatable roller or cylinder (16, 29, 424).

46. The system of claim 45, including means for applying said heatable roller against the printing form under resilient pressure

47. The apparatus of claim 45, further including non-contacting force means (26, 18') acting on said substance and positioned in the vicinity of said reproducing means (25) for assisting in the transfer of said substance to the printing form, wherein said non-contacting force means comprises at least one of:

magnetic means;

electrostatic means;

and wherein said substance is responsive to at least one of: magnetic force; electrostatic force.

48. The system of claim 36, wherein said printing form (4, 18) comprises a ceramic surface which is continuous and seamless

49. The apparatus of claim 36, wherein said recording head (9, 17, 1709) is a thermal transfer head having at least one heatable electrode for melting said substance at a point-shaped area.

50. The system of claim 36, wherein said recording head comprises a thermographic recording head having a plurality of heatable pin-type electrodes for transferring a plurality of image data derived from said electronic control unit by thermally affecting said substance.

51. The system of claim 36, wherein said printing machine printing form comprises a gravure printing form, said gravure printing form having receptor depressions or cells (307) on the surface thereof of sufficient depth to accept the maximum quantity of ink to be transferred to a substrate web (W).

52. The system of claim 51, wherein said substance on the movable transfer tape (415) is meltable under the influence of heat;

and said reproducing means applies energy to the transfer tape (415) for selectively melting substance particles from said foil or web (418) and introducing said substance particles into said cells or receptor depressions of said gravure printing form.

53. The system of claim 51, wherein said reproducing means transfer said substances in accordance with the image information derived from said control unit to the cells or receptor elements of the gravure form.

54. The system of claim 51, further including cassette holder means (30) for retaining said transfer tape (415) wherein;

wherein said printing machine comprise a plurality of printing forms; and means for selectively engaging the transfer tape in the cassette against a selected printing form.

55. The system of claim 54, further including energy supply means to supply energy to the transfer tape (415) in the cassette upon engagement against the printing form for transfer of said substance to the cells of the printing form.

56. The apparatus of claim 51, wherein the gravure form comprises a gravure cylinder having a continuous and seamless ceramic surface formed with said cells.

57. The system of claim 51, further including apparatus for erasing image information carried by said gravure printing form including heating means for heating the substance within the cells of the printing form;

and substance removal means (434) for removing liquefied substance from the cells of the printing form including at least one of:

wiper means;

suction means;

compressed air blowing means;

blotting means.

* * * * *